US006349526B1

(12) United States Patent
Newman

(10) Patent No.: US 6,349,526 B1
(45) Date of Patent: Feb. 26, 2002

(54) AUTOMATED PACKAGING

(76) Inventor: Paul Bernard Newman, Northcote House, Northlew, Okehampton, Devon EX2O 3BT (GB)

( * ) Notice: Subject to any disclaimer, the term of this patent is extended or adjusted under 35 U.S.C. 154(b) by 0 days.

(21) Appl. No.: 09/297,923

(22) PCT Filed: Sep. 14, 1998

(86) PCT No.: PCT/GB98/02764

§ 371 Date: Jul. 7, 1999

§ 102(e) Date: Jul. 7, 1999

(87) PCT Pub. No.: WO99/12664

PCT Pub. Date: Mar. 18, 1999

(30) Foreign Application Priority Data

Sep. 12, 1997 (GB) ..... 9719522

(51) Int. Cl.[7] ..... B65B 35/56; B65B 1/30; B65B 3/26

(52) U.S. Cl. ..... 53/446; 53/143; 53/544; 53/498; 53/54; 53/501; 53/502; 53/504; 53/425

(58) Field of Search ..... 53/142, 143, 544, 53/446, 54, 498, 501, 425, 500, 502, 504

(56) References Cited

U.S. PATENT DOCUMENTS

| | | | | | |
|---|---|---|---|---|---|
| 4,246,739 | A | * | 1/1981 | Rogerson | 53/143 |
| 4,720,961 | A | * | 1/1988 | Jordan | 53/502 |
| 4,776,146 | A | * | 10/1988 | Whitehouse | 53/446 |
| 5,165,219 | A | * | 11/1992 | Sekiguchi et al. | 53/142 |
| 5,237,801 | A | * | 8/1993 | Hillam et al. | 53/446 |
| 5,317,859 | A | * | 6/1994 | Schneider et al. | 53/544 |
| 5,339,607 | A | * | 8/1994 | Regier | 53/501 |
| 5,341,915 | A | * | 8/1994 | Cordia et al. | |
| 5,406,770 | A | * | 4/1995 | Fikacek | 53/502 |
| 5,463,839 | A | * | 11/1995 | Stange et al. | 53/54 |
| 5,667,827 | A | * | 9/1997 | Breen et al. | |
| 5,737,901 | A | * | 4/1998 | De Greef | 53/446 |
| 6,151,866 | A | * | 11/2000 | Connell | 53/502 |

FOREIGN PATENT DOCUMENTS

| | | | |
|---|---|---|---|
| WO | 94/09920 | * | 5/1994 |
| WO | 94/24875 | * | 11/1994 |
| WO | 95/21375 | * | 8/1995 |
| WO | 95/25431 | * | 9/1995 |

* cited by examiner

*Primary Examiner*—S. Thomas Hughes
*Assistant Examiner*—Eric Compton
(74) *Attorney, Agent, or Firm*—Larson & Taylor, PLC

(57) ABSTRACT

As a substrate (10) is carried on a conveyor (20), an image analysis system (40) detects its presence and derives the various data, at least indicative of the footprint. The footprint data are used in selecting appropriate packaging components. Data may also indicate the transverse location and/or orientation and/or alignment of a substrate, and be used to control position adjustors for adjusting one or more of these. Data may also serve for categorizing the substrate, e.g., in terms of size or color. Such data may be used to control rejection of products, or categorization, e.g., by selection of distinguishable packaging.

23 Claims, 16 Drawing Sheets

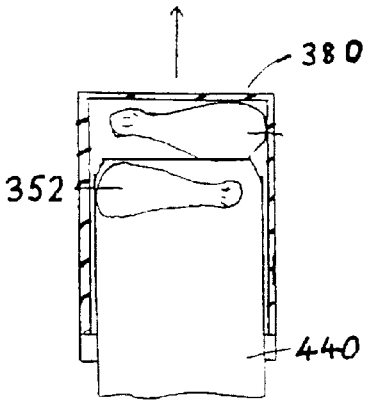
Fig 5a
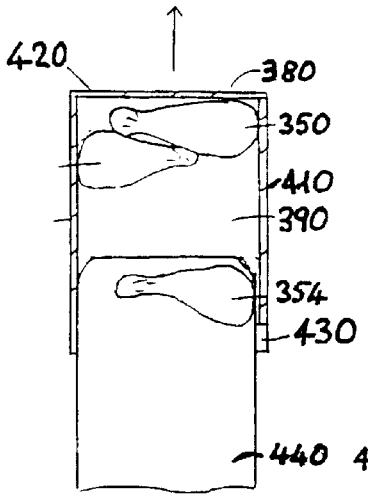
Fig 5b
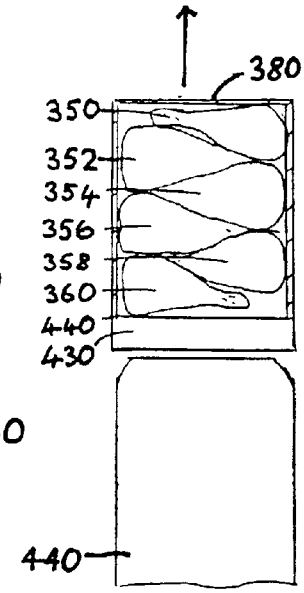
Fig 5c
Fig 2
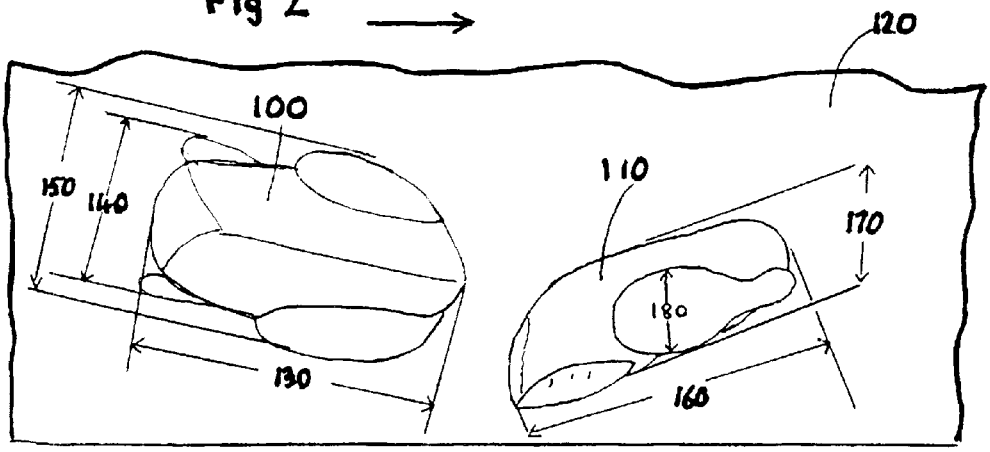

300
330
340
295
290
310
320
335
270
280

A 1480
1470
1450
1490
1500
1490
1390
1350
1380
C
1350
1360
1420
1410
1510
1520
1450
1365
1530

Fig 21A
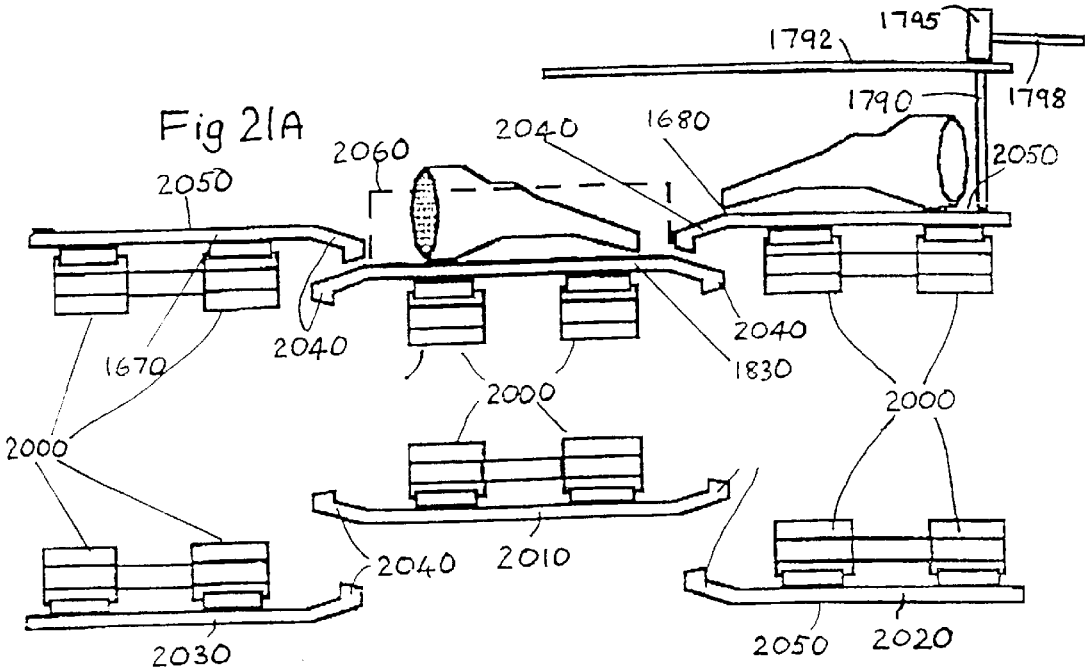
Fig 21B
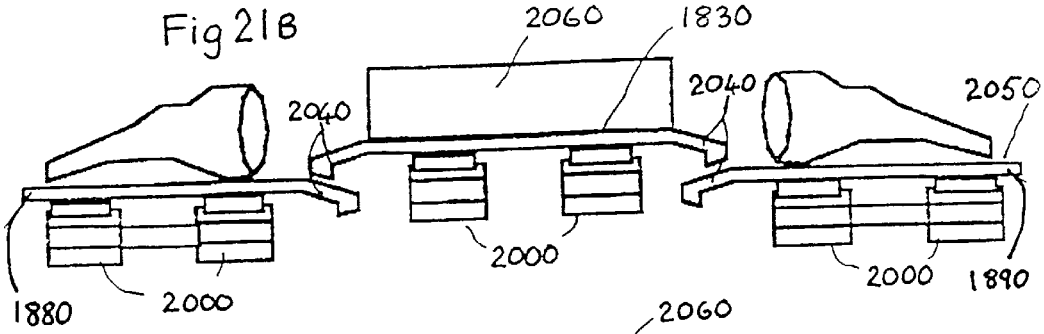
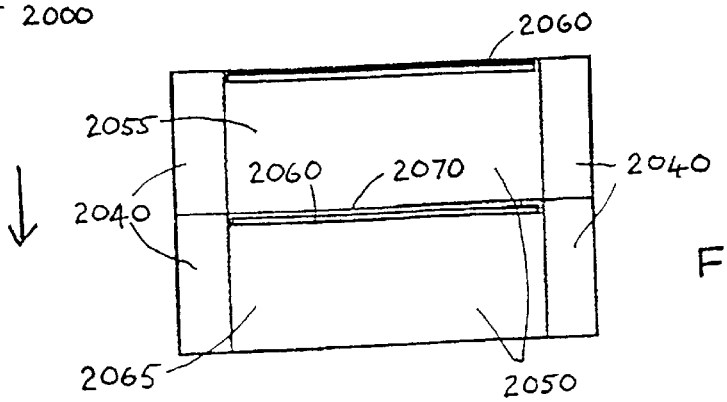
Fig 22

Fig 23A
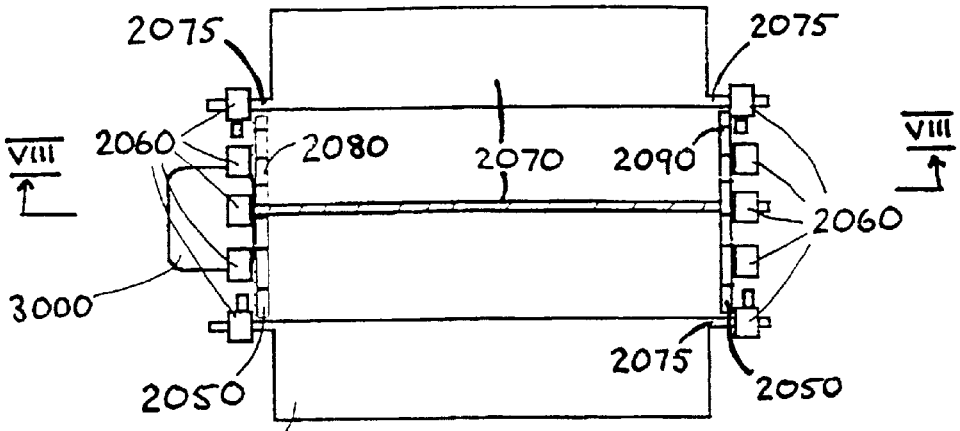
Fig 23B
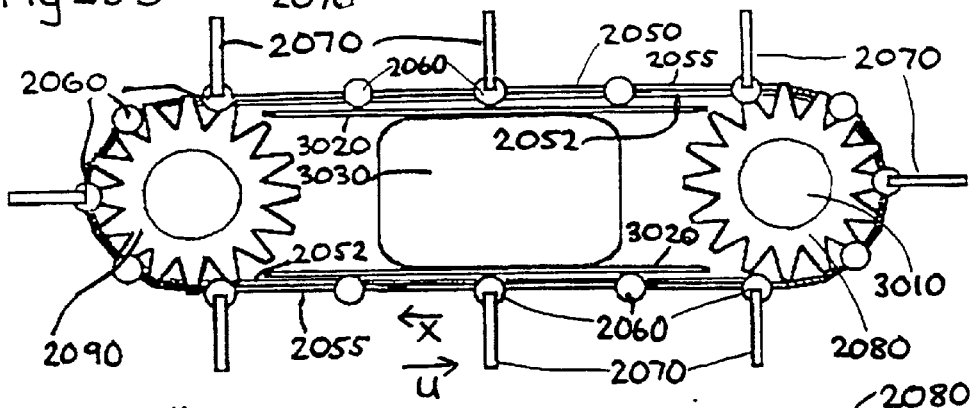
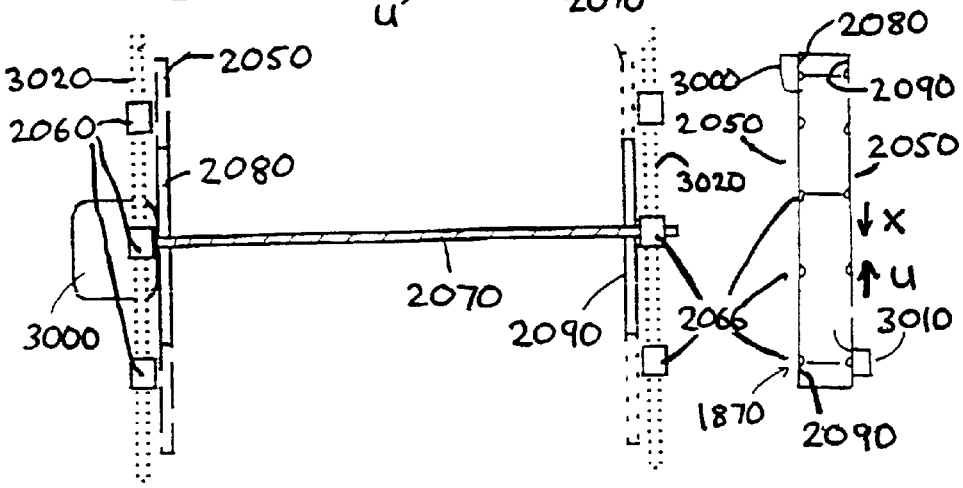
Fig 23c

AUTOMATED PACKAGING

TECHNICAL FIELD

This invention relates to automated packaging of substrates, particularly (but not exclusively) food-related. Preferred embodiments relate to the automated conveying, selecting, and packaging of food, particularly under aseptic or near-aseptic conditions.

BACKGROUND ART

Currently the food industry in particular makes much use of manual labour for packaging. The performance of such packaging systems is notoriously variable, due in part, it is believed, to many of the manual operations associated with packaging being highly repetitive. This is especially the case with the packaging of meat and meat products, where the packers work for comparatively long periods in chilled and damp conditions. Such work can often involve moving heavy items, as well as items that are difficult to handle under the conditions. It is perhaps not surprising that injury to personnel is common, and absenteeism frequent. These factors combine to produce high turnover of staff, and a high and recurring cost of training replacement staff.

Excessive manual handling of food at any stage in its manufacture, including the packaging stage, results in a significant increase in both the type and the number of microbial contaminants. This effect can be compounded by the modern trend towards centralised packing of food, which, although it offers considerable financial benefit, greatly increases the potential for cross-contamination and recontamination. Microbial contamination leads to reduced shelf-life, deterioration in product quality, appreciable waste of material, and overall a considerable loss in value. At least as important as this loss in value, microbial contamination is a major source of human food-borne illnesses.

Automation has the potential to reduce costs, by increasing throughput and reducing or virtually eliminating the requirement for training of staff. Well-designed automated lines can help reduce the incidence and extent of microbial contamination of food: however, the risk of cross-contamination may actually be enhanced because a greater proportion of the throughput is exposed to the same contact surfaces, and if a pathogenic strain is present, the number of consumers becoming ill could increase dramatically.

The packaging industry has already developed a considerable amount of high speed equipment capable of handling, packing and collating very small, regularly shaped items presented in perfect orientation, particularly confectionery. To date, automation of food packaging lines has been limited to packaging small, regularly shaped, fully processed foods; in the meat industry, for example, products such as burgers, pies, and sausages are packaged in a semi-automatic manner in a few factories. Many established methods rely on "pick and place" procedures which are inherently slow, and the use of robotics in such methods adds considerably to the cost.

DISCLOSURE OF INVENTION

A packaging line embodying the present invention may be able to handle substrates such as foods of a wide variety of different shapes and sizes, at high throughput speeds, and is particularly well-suited to running under aseptic or near-aseptic conditions.

In a first aspect, the present invention provides a method of packaging a substrate comprising (i) conveying the substrate on a conveyor into the field of view of an image analysis system and obtaining an image of the substrate on the conveyor from said system, (ii) comparing the image of the substrate against standard images held in a database, and thereby identifying the substrate and optionally its orientation,(iii) optionally analysing the image of the identified substrate on the conveyor to determine the location of the substrate transverse to the conveying direction, (iv) optionally analysing the substrate image to determine the alignment of the substrate relative to the conveying direction, (v) analysing the substrate image and, with reference to the database if necessary, determining the footprint dimensions of the substrate, (vi) optionally, using the data obtained in any of steps ii–v to effect positional adjustment of the substrate on the conveyor, (vii) selecting a package or a first package component according to the footprint dimensions,(viii) transferring the substrate to the package or component, (ix) providing further components of the package if necessary, and integrating said further components with the first component, and (x) sealing the package. Preferably, the method is conducted substantially within a cavity (eg a chamber or tunnel), said cavity being provided with a plurality of UV sources distributed around the walls of the cavity and directed radially inwardly such that UV radiation from the UV sources maintains substantially aseptic conditions within the cavity throughout the process. The method may form part of a process of handling edible substrates wherein one of the upstream operations includes reducing microbial numbers on the surface of said edible substrate by exposing said edible substrate to UV-irradiation, preferably said upstream operation being effected according to WO94/24875 (or U.S. Pat. No. 5,597,597), incorporated herein by reference.

The image analysis system serves to detect the presence of a substrate in its field of view and may, indeed, serve to locate its position more precisely within that field of view. This detection may be used to synchronise the operation of one or more processes effected downstream.

The conveyor is preferably an indexing conveyor. The conveyor preferably has means defining compartments for confining substrates. Preferably the compartments are defined by barriers to movement (relative to the conveyor) in the conveying direction, whereas at least some displacement in the transverse direction is possible.

I may provide a conveyor having a conveying direction, and means for displacing subjects on the conveyor transversely to the conveying direction. The displacing means may comprise a pusher and means for displacing the pusher over the conveyor, close to it but generally not in contact with it. Thus the pusher may be carried by an endless belt or chain which extends over the conveyor and is preferably drivable selectively in either direction.

I may provide a packaging station adapted to produce a package including a bottom component and one or more liner components (e.g. an absorbent pad and/or a support sheet having support protrusions such as corrugations or raised dimples). The bottom component may have a pair of end portions which are bent upwardly to provide end walls, which may support an overwrapping film out of available to be selected, for whatever reason, the substrate is rejected.

The selection of a component or package may be used to effect sorting and/or grading of the substrate. "Sorting" as used herein means determining to which category of product a substrate belongs, and selecting a component or package according to a) the footprint dimensions of the substrate image, and b) the category of product to which the substrate belongs; while "grading" as used herein means determining to which class within a category a substrate belongs, and selecting a component or package according to a) the footprint dimensions of the substrate image, and b) the class to which the substrate belongs within a category of product. Accordingly, the method preferably further comprises sorting and/or grading the substrate according to a) weight, or b) product requirements, or c)customer specifications, or d) colour (including discolouration, such as any caused by eg bruising or blood splash), or e) any combination of a–d. Preferably, the method further comprises sorting and/or grading the substrate according to product requirements or customer specifications. Preferably, the method further comprises sorting and/or grading the filled package (ie the package itself and the substrate(s) contained therein) according to product requirements or customer specifications, as an additional contact with a substrate within the package. Note: unless the context requires otherwise, "footprint" and related terms are used herein to refer to the outline of a substrate as viewed in plan when it is in its intended orientation for packaging. It does not generally refer to the area in contact with the support surface, if this is different.

At least part of the method may be conducted in filtered air or in a modified atmosphere; a modified atmosphere being one in which the proportion of at least one of the gaseous constituents is different from the proportion of the said one gaseous constituent in air. Preferably, the modified atmosphere includes inert gas at a higher concentration (in terms of its proportion of the modified atmosphere) than its natural concentration in air. Preferably, the modified atmosphere has the same or a substantially similar composition to a gas mixture which is used in gas packing of the final package.

In many circumstances, the method will further comprise obtaining the weight of the substrate, and preferably including said weight as a factor in selecting the package or first package component step vii. The selection of a component or a package may comprise selecting a conveying line which is provided with the component or package and moving the substrate to said conveying line. If a suitable component or package is not step performed before or after sealing the package.

In a second aspect the invention provides a packaging line which comprises: conveying means; an image analysis system ("IAS") suitable for obtaining images of substrates while they are being conveyed on the conveying means; means for comparing said images against standard images held in a database and on the basis of this comparison i) recognising each substrate, ii) estimating the footprint of each substrate, and optionally iii) determining the orientation of said substrate; a placement module; a controller or co-ordinater, able to direct the action of a placement module to select a first package component or a package on the basis of said footprint and arrange for said component or package to receive the substrate on transfer to the placement module; and a final package assembler. Preferably, the packaging line is contained substantially within a cavity (eg a chamber or tunnel), said cavity being provided with a plurality of UV sources distributed around the walls of the cavity and directed radially inwardly. Preferably, the image analysis system is further capable of determining the location of a substrate transverse to the conveying direction. Preferably, the image analysis system is capable of determining the alignment of the substrate relative to the conveying direction. Preferably, the packaging line constitutes part of a processing line in which one of the upstream units or modules is a UV sterilisation unit, most preferably said UV sterilisation unit being as described in WO94/24875, incorporated herein by reference. Preferably, the final package assembler is provided with means for dispensing a modified atmosphere during at least part of the assembly of the final package before sealing the final package.

Preferably, the conveying means comprises one or a plurality of indexing conveyors. Preferably, the conveying means is compartment.

The packaging line may be equipped with reject mechanisms. These may be triggered by the IAS if it does not recognise the object or recognises the object but it is outside a pre-set quality or dimensional criterion.

The packaging line may also be provided with means for positional adjustment, as herein defined, of a recognised substrate. Positional adjustment is preferably under the control of the IAS, either directly, or indirectly via a separate microprocessor controller or programmable logic controller (PLC) ("controller" is used herein to encompass either direct or indirect control of the action of downstream equipment by the IAS). Preferably, the means for positional adjustment comprise a plurality of retractable arms provided with blades, said blades being arranged such that the lowermost surface of each blade is close to, but does not touch, the upper run of the conveyor. Positional adjusters are preferably sited on either side of the conveyor so as to be able to act co-operatively in effecting positional adjustment. Preferably, the means for positional adjustment comprises a continuous chain, one or a plurality of pulleys, and a pulley drive, said continuous chain being provided with flanges which in use descend from lower surface of the continuous chain to approach but not touch the upper surface of a product line conveyor. Robotic arms may alternatively be used as positional adjusters. Substrate alignment may alternatively be adjusted by use of variable speed multi-section conveyors. The means for positional adjustment may alternatively or additionally be used as reject mechanisms.

In a preferred embodiment for packaging poultry drumsticks according to the present invention, the conveying means comprises a chute and a primary conveyor, said chute comprising a conically shaped entry head leading to a tubular section with walls which gradually taper to a chute exit. The IAS is positioned so as to obtain an image of a poultry drumstick while the drumstick is on the primary conveyor. The conveying means may further comprise a weigh scale conveyor situated upstream of the chute. In a particularly preferred embodiment, the conveying means comprises a) a processing rail, for conveying drumsticks on gambrels; leading to b) a chute, as just described, for receiving drumsticks following dismounting of said drumsticks from said gambrels; leading to c) a primary conveyor. Preferably, the processing rail is provided with a means for weighing gambrels, with or without drumsticks; a suitable means for weighing gambrels is an in-line weigh beam. Preferably, the image analysis system is further suitable for obtaining an image of a drumstick while it is on a gambrel on the processing rail, in which case suitable means for analysing said image of a drumstick will also be included in the line.

The term "location" is used herein to refer to where a substrate is to be found on a conveyor transverse to the conveying direction; "alignment" refers to the agreement between a notional axis of a substrate and the conveying direction; "orientation" refers to which surface of the substrate is in contact with the uppermost surface of a conveyor (in other words, "orientation" indicates whether the substrate is the right way up or, for example, upside down); "position" can encompass one or more of location, alignment, and orientation; "positional adjustment" means altering the position of a substrate on the conveyor to a different position on the conveyor, said different position being a position suitable for the transfer of the substrate to a base component of a package; a position referred to as being "correct" is one in which the corresponding substrate is suitably positioned for transfer to a base component of a package, and conversely a position referred to as being "incorrect" is one in which the corresponding substrate requires positional adjustment before such a transfer.

The term "image comparison" is to be interpreted in a broad sense; for example, it is to be understood as including all techniques used in image analysis. As an illustrative and non-exclusive example, it is to be interpreted as including a comparison of two or more data files, at least one of which said files contains connectivity data from or of part or all of a specific edible substrate (the "test" substrate) and at least one other of which said files contains corresponding connectivity data from or of part or all of a further specific edible substrate obtained previously (the "standard" substrate); in other words, every "image" which is to be included in the comparison is described by the image analysis system and/or the reference database mathematically, eg length, roundness, perimeter, major/minor axis, etc. Similarly, the term "image" should be considered, in context, as including the meaning "image description", ie the image is or has been obtained or stored as a data array in a data file. Some embodiments of the invention will now be described with reference to the figures.

BRIEF DESCRIPTION OF DRAWINGS

FIG. 2 is a close-up view of two poultry carcasses, viewed from above a conveyor;

FIG. 5 is a plan view of a part-formed tray being loaded with substrates in a placement module;

FIGS. 21A and 21B are, respectively, sections on IV—IV and V—V in FIG. 20A;

FIG. 22 is a plan view of two conveyor slats of the line of FIG. 20; and FIGS. 23A, 23B, 23C and 23D are views of a bidirectional positioner, located generally above the line of FIG. 20A, FIG. 23A being an end elevation looking along arrow VI in FIG. 20A; FIG. 23B being a side elevation in the direction of arrow VII in FIG. 20Al FIG. 23C being a plan view and FIG. 23D being a schematic overall plan view.

MODES FOR CARRYING OUT THE INVENTION

Figure 1:
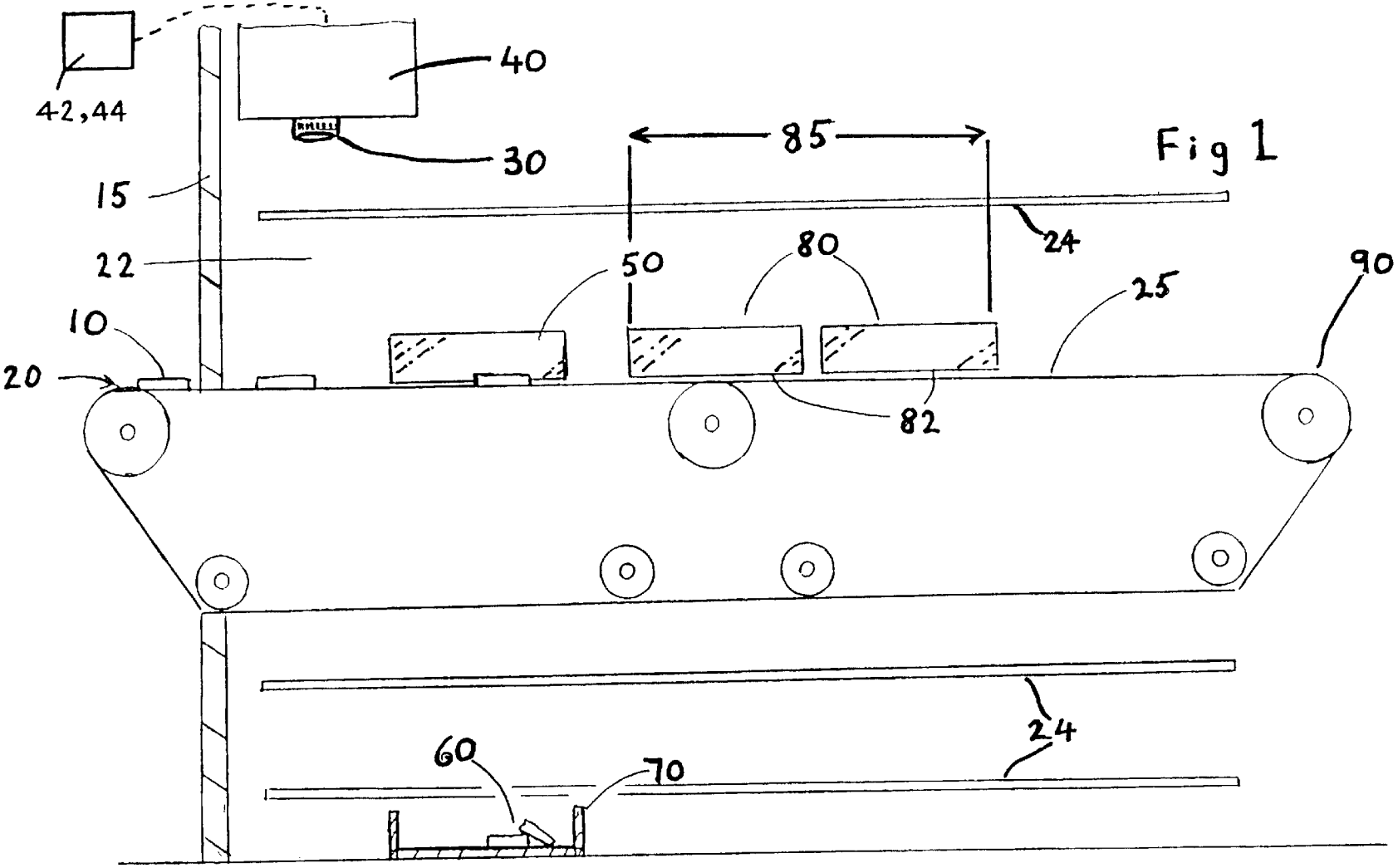
FIG. 1 is a schematic side view of a part of a packaging line embodying the invention, upstream of the placement module.

As shown in FIG. 1, an edible substrate 10 is initially placed on a conveyor belt 20 where the belt projects from a treatment cavity 22. The substrate is conveyed through wall 15 into treatment cavity 22, which is irradiated with ultra violet light from UV sources 24, to within the field of view of a lens 30 attached to an image analysis system (IAS) 40. The field of view of the lens 30 will usually be such as to encompass the whole of the width of the conveyor 20. One of the early tasks for the IAS 40 is to isolate the image of the substrate 10 from the total image by dropping out the background image of the conveyor. The IAS then attempts to recognise the substrate by comparing the image of the substrate 10 against a variety of images stored in a database 42 which may be part of a microprocessor controller or PLC44. Recognition of the image may involve rotating the image, in addition to any scaling of the image that may be needed.

The size and complexity of the database will usually depend on the foods being packed, the quality assurance requirements of the product line, and the degree of sophistication of the system as a whole. Many food packaging lines will require the provision of a database which includes standard images of the appropriate foods taken from different angles, so that the food can be recognised irrespective of the view of the food presented to the lens 30. This is illustrated in FIG. 2, which shows two poultry carcasses 100, 110 on a conveyor 120. Carcasses 100, 110 are of similar size but have different orientations. A suitably compiled database will include both an image of a carcass in the correct orientation 100 and an image of a carcass in an incorrect orientation 110 (note that these orientations are referred to as correct or incorrect purely for illustration; the "correctness" of a substrate will be determined by the line as a whole and not by any inherent limitation of the invention). Some foods will, of course, have more than two possible orientations in which they can be viewed by the IAS, and ideally all the possible orientations will be represented in the database (or derivable from other images via appropriate software). On the other hand, several foods can be considered in the context as planar, with only one orientation likely: burgers, steaks, and chops, for example, are unlikely to be presented edge on to the lens, and the surface hidden from the lens is effectively identical to the surface presented to it; such foods require only one image to be stored in the database.

Once the image of the substrate has been recognised, the IAS 40 assesses key dimensions of the substrate and determines a suitable footprint for the substrate from these dimensions. The key dimensions of a substrate can differ according to the nature of the substrate itself, and the type of placement module used. For example, in a poultry packing line in which the carcasses are placed on package base components comprising pre-formed polystyrene trays, the key dimensions of carcass 100 (FIG. 2) could be the length 130 of the carcass, and the width 140, 150 of the carcass measured at the position of the wings and thighs, respectively.

If the line is set up to accept substrates in incorrect orientations, the software derives the footprint from the incorrect image: for example, the footprint of incorrectly orientated carcass 110 cannot be calculated directly, as there is no information on carcass width available from the image, but the footprint might nevertheless be estimated from a manipulation of obtainable data e.g. carcass length 160, maximum height 170 of the carcass, and maximum width 180 of the drumstick.

Once a substrate has been recognised and its footprint has been determined, the IAS returns to the image of the substrate 10 on the conveyor 20 and determines the precise location of the substrate.

The IAS can additionally be used for quality assurance. For example, it may be thought desirable to have a particular length of rib associated with a chop, and the upper and lower levels for this quality criterion can easily be incorporated as a subroutine within the recognition program. Chops recognised as such by the IAS but with rib length outside these pre-set limits can be rejected in much the same way as objects that cannot be recognised. This same approach can be used to set up a line for packing for more than one customer at a time; for example, a packer may have two customers for chops, the first customer having a stricter specification than the other. The specification can be incorporated into the program so that, for example, chops recognised as such and meeting the specification of the first customer can be directed by the IAS to be packed in the first customer's livery, while chops recognised as such but not meeting the specification are assigned to the second customer's packs. (This is a simple example of the use of the system in grading, in that the two customer's specifications define two classes within the pork chop category.)

Substrates not recognised by the IAS may be recognised by a human operative and allowed to continue on the conveyor. Objects that are not recognised, or recognised substrate that fails quality criteria, are rejected from the line in any of a variety of ways. For example, in FIG. 1, the IAS may trigger blade 50, which is mounted on a retractable arm, to be moved transversely over the conveyor 20 (ie in FIG. 1, towards the viewer) and push the rejected object off the conveyor 20 into bin 70 placed to collect rejected objects 60.

Figure 3A:
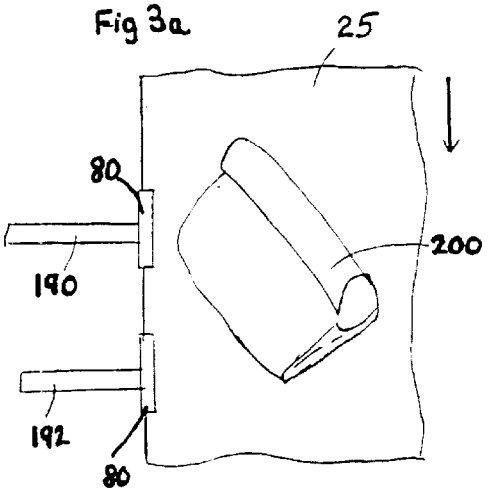
FIG. 3 is an overhead view of a pork loin in a region of positional adjustment: a) before realignment, b) at the completion of realignment.
Figure 3B:
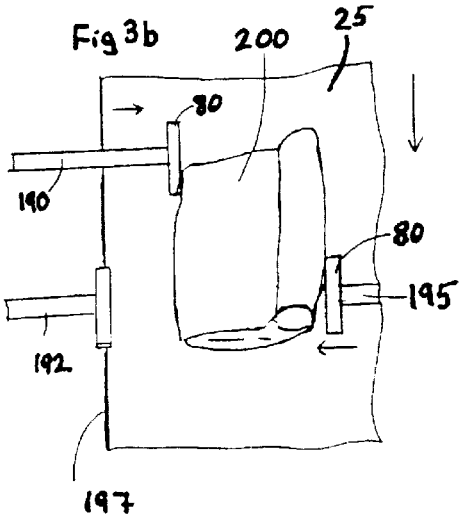

Recognised substrate is conveyed into the region of positional adjustment 85. The requirement to adjust the alignment of the substrate will depend on the shape of the substrate, the shape of the base component of the package to be used, and the final package assembler. Circular substrates, such as some burgers, are unlikely to need realigning, and similarly in some lines the use of circular packages or components can obviate realignment. However, in the majority of cases the ability to correct substrate alignment will be required. One approach is shown in FIGS. 1 & 3, in which retractable arms 190, 192, 195 are provided at their ends with blades 80 whose lowermost surfaces 82 are close to, but do not touch, the upper run 25 of conveyor 20. (The nearside apparatus has been omitted from FIG. 1 for clarity.) As loin 200, which is incorrectly aligned, enters the region of positional adjustment 85, one or more retractable arms 190, 195 are extended under the direction of the controller so that blades 80 first contact the sides of loin 200 and then displace the loin transversely to the conveying direction. FIG. 3*b* shows retractable arm 190 working co-operatively with retractable arm 195 which has been extended from the opposing side of the conveyor 20.

The arrangement shown in FIG. 3 can also be directed by the controller to correct a substrate's location: for example, if it was necessary to move loin 200 away from the leftmost edge 197 of the conveyor, arms 190 and 192 could be further extended (and arm 195 retracted) to push loin 200 to the desired location.

Figure 4A:
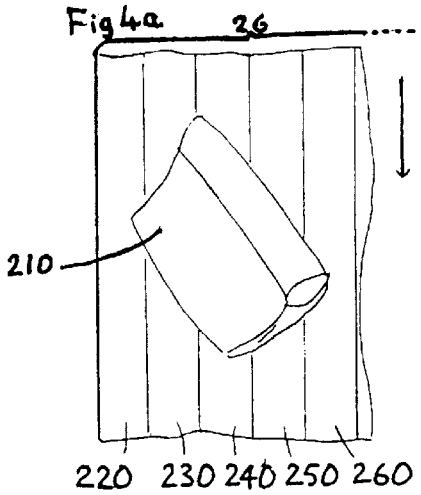
FIG. 4 shows an alternative arrangement for realigning a pork loin: a) before realignment, b) at the completion of realignment.
Figure 4B:
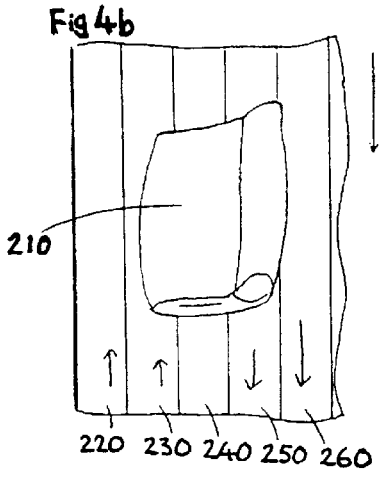

FIG. 4 shows another way of realigning a substrate, using a variable speed multi-section conveyor. Loin 210, which is incorrectly aligned, is conveyed on conveyor 26 which comprises a series of individually controlled sections 220, 230, 240, 250, 260. The alignment can be adjusted by increasing the speeds of sections 250 & 260 relative to the speed of section 240, while at the same time either reducing the relative speeds of sections 220 & 230 or reversing their direction. Conveyors of the type shown in FIG. 4 would probably only be included as a comparatively short run in a packaging line so as not to reduce the overall throughput.

Following positional adjustment, the loin 200,210 is conveyed to a placement module, where it is transferred to a package or a component of a package, for example a bag or pouch. The filled package will be conveyed to a final package assembler where the atmosphere of the package may be modified by conventional methods and sealed.

Precise identification of the location of a substrate and the co-ordinates of the substrate's footprint, used in conjunction with information on conveyor speed (including delays incurred by positional adjustment), allows the controller to position the selected package or component to receive the substrate as it enters the placement module. (A placement module is not shown in FIG. 1, but one could be conveniently situated at the discharge end 90 of conveyor 20. The placement module will preferably operate throughout under UV irradiation, to maintain aseptic conditions and eliminate the risk of either the surfaces of the placement module or the packaging acting as a source of recontamination.) In many cases, the controller uses the footprint of the substrate to instruct the placement module to select a pre-formed or part-formed base component of a pack such as a tray. The selection may be from different sizes and shapes of tray (eg lines producing retail packs of different poultry cuts—wings, thighs, and breasts, for example); or from trays of the same shape but of different size (eg lines for packing uncooked poultry carcasses of a range of weights); or from pre-formed bags or pouches, for example for packing hams for wholesale (where the weight range may be from 4 to 12 Kg; selection of bag size is still made on the basis of the respective footprint); or from any other type of pack in the art. Similarly, the placement module could be directed by the controller to steer the substrate to a particular mould (for example, in a deep-draw packaging system) selected for size and shape according to the substrate's footprint. At the other extreme, in some cases, such as certain skin packers, the function of the placement module is subsumed by the final package assembler: in such cases, the controller can use the footprint data to direct the cutting of a base web and thereby create the base component.

Figure 6B:
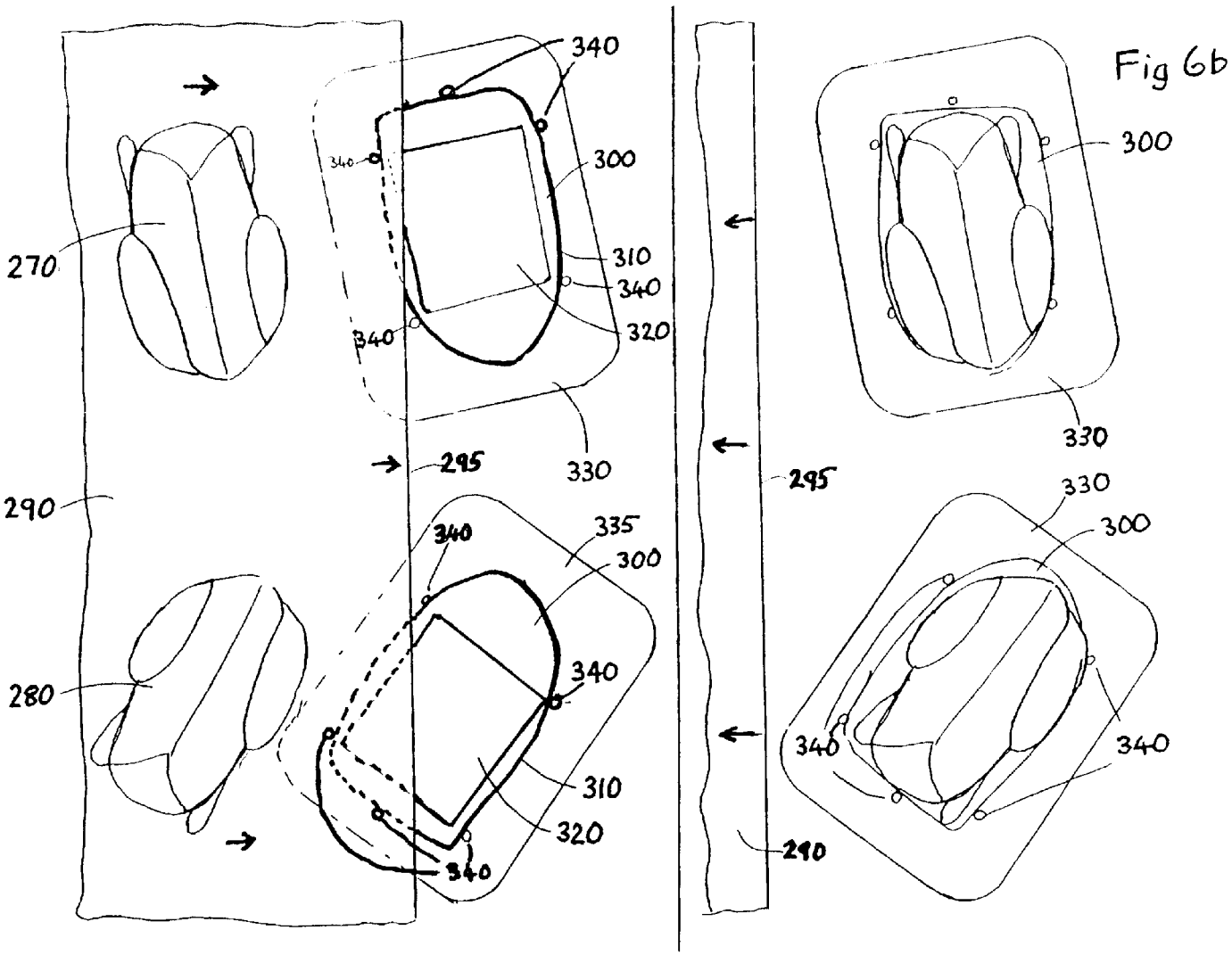
FIG. 6 is a plan view of two substrates transferring to pre-formed trays in a placement module.

The placement module may have as a feature the ability to rotate the package or component thereof to allow for the alignment of the substrate. In such a case, there is little or no need to effect any alignment adjustment upstream, although adjustment to location and/or orientation might still be necessary. One such feature is shown in FIG. 6. In FIG. 6*a,* poultry carcasses 270, 280, which differ in alignment, are shown on the uppermost run 290 of a retracting conveyor, the leading edge 295 of which is shown partly occluding placement module turntables 330, 335. Package base components 300, each comprising a pre-formed dished polystyrene tray 310 and absorbent pad 320, have been placed on turntables 330, 335 and are retained in position by lugs 340. Under the direction of the controller, turntables 330, 335 are rotated into the correct alignment relative to carcasses 270, 280 respectively. When the carcasses have been conveyed to the position for transfer to the placement module, conveyor 290 is retracted and the carcasses are transferred to their corresponding base components (FIG. 6*b*). If necessary, the controller can instruct the placement module to rotate either or both turntables 330, 335 to a suitable common alignment as required by the final package assembler. The assembly of the final pack (which again occurs preferably while it is irradiated continuously with UV light) might be by transferring the carcass and base tray into a bag, flushing with modified gas, and sealing.

Packaging lines can of course be set up to produce packs with more than one substrate. Such packs frequently require that the constituent substrates are arranged within the pack in a specified conformation. This is illustrated in FIG. 5, in which drumsticks 350, 352, 354, 356, 358, 360 are shown being transferred onto base component 380. Base component 380, which is of card, is a part-formed tray and comprises a floor 390, two opposing side walls 400, 410, a first end wall 420, and a trailing flap 430. As base 380 is conveyed in the direction of the arrow, drumsticks transfer successively from guide chute 440 until the pack is complete. The alternating arrangement of the drumsticks will probably have been initiated as they were first placed on the conveyor, but such placement will probably have been manual and is therefore unlikely to have been sufficiently precise for the throughput required. Automated positional adjustment of individual drumsticks by the line, as required, greatly increases throughput and reduces subsequent rejection of unsatisfactorily filled packs.

The filled base component is conveyed to a final package assembler, where the base component is completed by folding flap 430 upwardly along crease 440 to form the second end wall of the tray. The final package might be assembled by overwrapping the filled base, heat sealing, and affixing labels.

EXAMPLE 1

This example describes a chicken drumstick packaging line embodying the invention. In the following description, the functions of the IAS in obtaining an image, manipulating the image data and comparing them with reference data in a database, determining the position of a substrate, and controlling the operation of the line have been simplified to illustrate the working of the invention; in particular, it should be appreciated that the order in which the image is analysed will depend on software and is not crucial to the invention.

Figure 7:
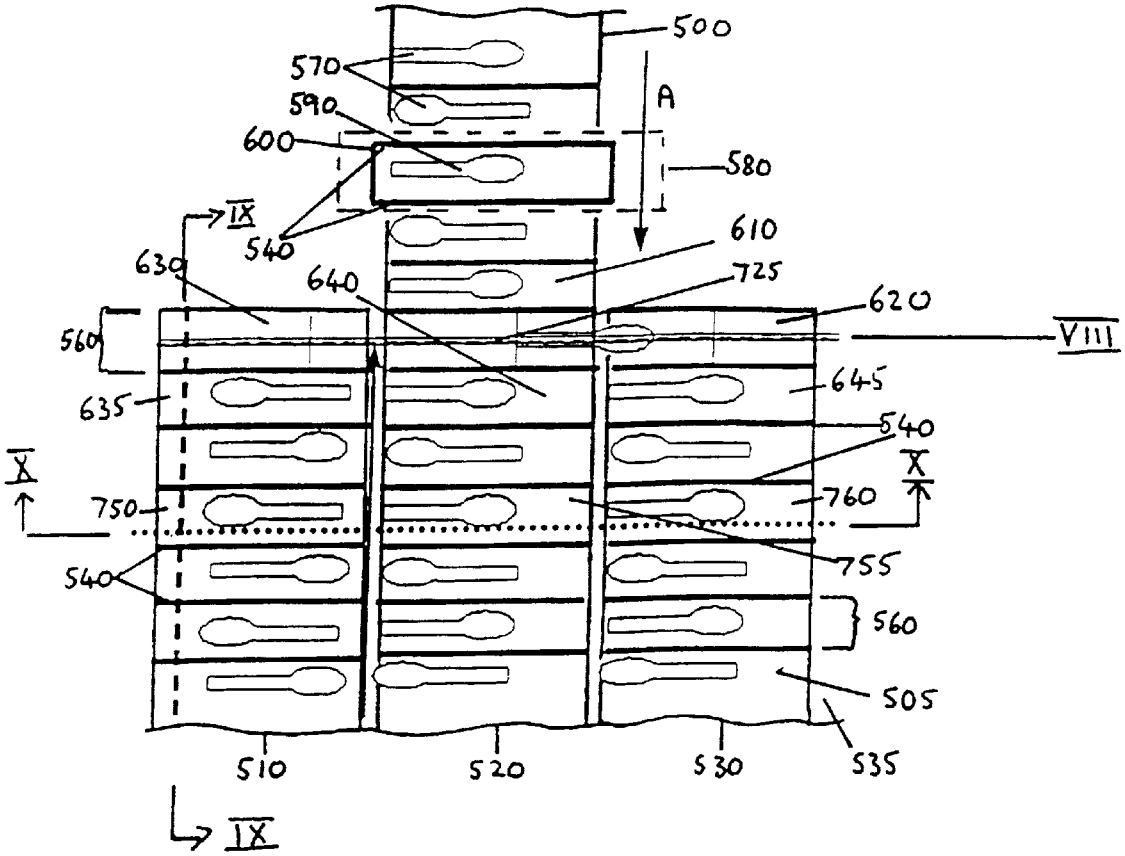
FIG. 7 is a schematic plan view of a part of another packaging line embodying the invention, upstream of the placement module and final package assembler.

Referring to FIG. 7, the conveying means comprises primary indexing conveyor 500 and product line indexing conveyors 510, 520, 530. Primary indexing conveyor 500 and product line indexing conveyors 510, 520, 530 comprise plastic interlock belting 505 with raised flanges 540 defining compartments 560.

Chicken drumsticks 570 are initially conveyed, in the direction of arrow A, into the field of view 580 (shown by hashed lines in FIG. 7) of an IAS. The IAS obtains an image of drumstick 590 while it is within the field of view 580 and compares the image against images held in the IAS database. Suitable software allows the IAS to recognise and accept drumsticks in any orientation, while compartments containing objects that are not recognised by the IAS are "flagged" for rejection of the object downstream. Once recognised, the location of the drumstick is determined from the image and any compartments with a drumstick incorrectly located, for example overhanging one edge of conveyor 500, are similarly flagged within the IAS for rejection.

The IAS determines the alignment of drumstick 590. Although the raised flanges 540 normally restrict drumstick 590 to an alignment of either substantially 90° or 270° (hereinafter EW or WE alignment, respectively) a drumstick will occasionally lie across a flange, and will be flagged by the IAS for correction or rejection. If orientation is important, a rolling device, for example, or other rotation means (e.g. as described in Example 5) can be incorporated downstream to turn the product over and correct orientation.

The drumstick image can also be analysed by the IAS on-line to assist quality control. For example, the following dimensions (which are some of the footprint dimensions of the drumstick) can be determined to ensure that the drumstick is within a pre-programmed minimum/maximum range: a) overall length along main axis; b) overall width across minor axis; c) overall length across drumstick "head"; and d) overall width across drumstick "head". Compartments with drumsticks lying outside the acceptable range will be flagged for rejection. The IAS can also be programmed to recognise and flag common quality defects, such as bruising, obvious physical damage, and obvious broken femur.

All data obtained from an image are stored by the IAS as a record.

The use of a comparted indexing conveyor facilitates tracking of individual drumsticks by the controller. The use of an indexing conveyor also ensures the product is intermittently stationary, typically for about 0.8 seconds. This period allows the weight of drumstick 590 to be obtained by in-line weigh platform 600; the weight is added to the corresponding record.

Figure 8:
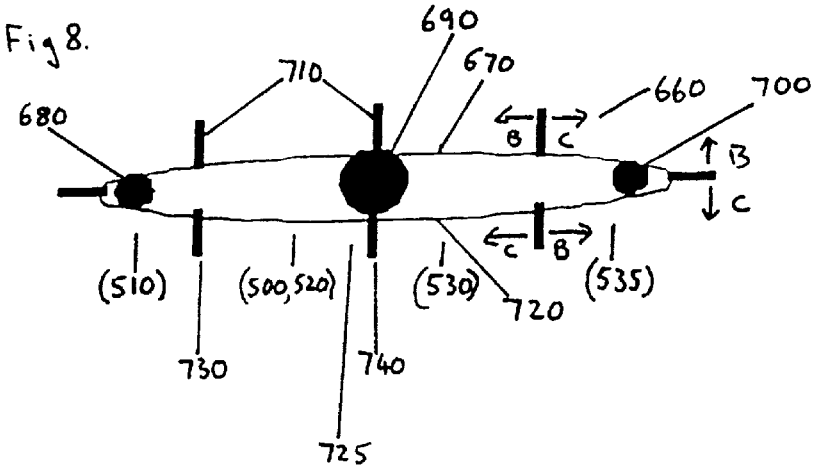
FIG. 8 is a schematic side section of a positioner, as used for effecting positional adjustment or rejection of recognised substrate in the packaging line shown in FIG. 7.

The positioner for effecting positional adjustment is shown diagrammatically in cross section in FIG. 8. Positioner 660, which has been omitted from FIG. 7 for clarity, is located at VIII in FIG. 7 transverse to the conveying direction above product line conveyors 510, 520, 530 and reject channel 535. The positioner 660 comprises a continuous chain 670, pulleys 680, 700 and pulley drive 690. Continuous chain 670 is provided with flanges 710 which in use descend from lower surface 720 of chain 670 to approach but not touch the upper surface of a product line conveyor. Positioner 600 is shown in FIG. 8 in the rest position, which position allows the indexed movement of primary belt 500 to transfer a drumstick to compartment 725, now additionally defined by flanges 730, 740. (The position of product line conveyors 510, 520, 530, primary conveyor 500, and reject channel 535 relative to the components of positioner 600 in the rest position are shown in parentheses).

Pulley drive 690 is able to move chain 670 in either forward or reverse motion. Being a continuous drive it does not have to return to a "home" position before being reactivated, nor does the controller need to keep track of the drive's location as the indexing motor which drives pulley 690 will ensure it is always correctly positioned over the conveyor.

As the drumstick moves from the final compartment position 610 of primary conveyor 500 into compartment 725, the controller applies an algorithm for both alignment (when packed, the drumsticks are alternately aligned EW, WE) and minimum giveaway and determines whether the drumstick continues to compartment 640 of product line conveyor 520, or is pushed by positioner 660 one place to the right or left (as seen in plan; direction shown by arrows B and C, respectively, in FIG. 8) across the abutting plastic conveyors to compartment 620 or 630, respectively. Drumsticks with footprint dimensions lying outside those suitable for the base component of the package, and other drumsticks flagged for rejection for any other reason, are moved two places to the right off conveyor 530 into reject channel 535.

When all movement of product transverse to conveyor direction by positioner 660 has been completed, the receiving product conveyor and primary conveyor 500 index one compartment, pushing a new drumstick into compartment 725 (or its successor, as appropriate).

Figure 9:
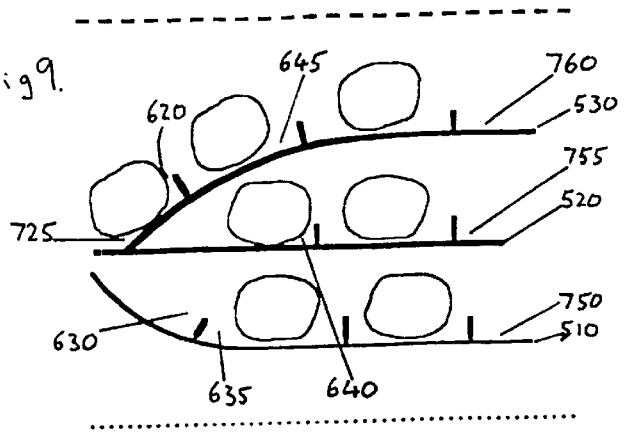
FIGS. 9 & 10 are sections on IX—IX and X—X respectively in FIG. 7.
Figure 10:
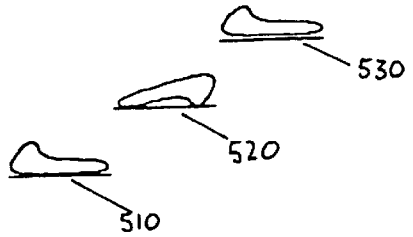

As shown in FIGS. 9 & 10, the packaging line configuration can be made very compact by changing the elevation of product conveyors 510, 520, 530 following product assembly and positioning. This arrangement is especially suitable for collating several retail packs into convenient bulk units (eg bulk units with 3×4 retail packs or with 6×4 retail packs) for wholesale delivery to stores and supermarkets. Packing for each line occurs in a vertical stack, and therefore the description below applies to all pack lines.

Figure 11:
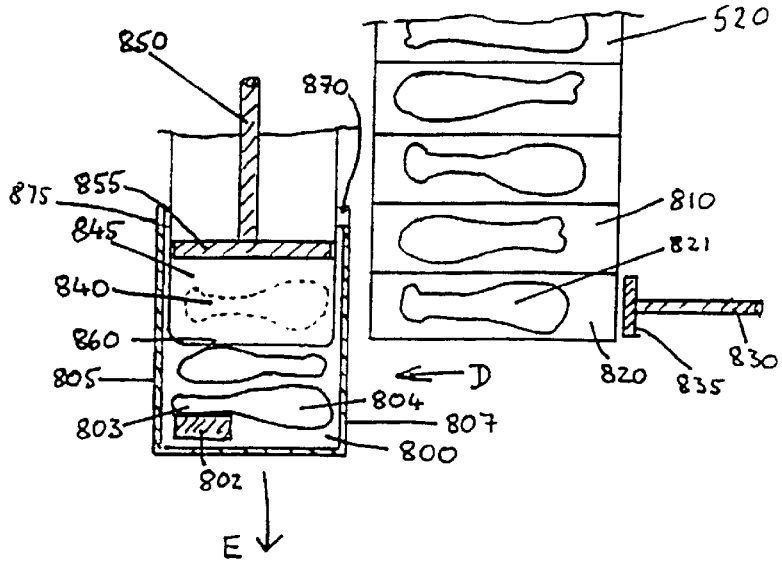
FIG. 11 is a plan view showing the transfer of substrates to a base component of a package in a placement module.

The selection of a base component of a package has been effected in this example by moving each drumstick to a suitable conveying line. FIG. 11 shows the individual drumsticks at the placement module being transferred from product conveyor 520 (as a representative example) to a base component 800 of package 805. Base component 800 has a raised inset 802 on the left hand side (lhs) against which knuckle end 803 of first drumstick 804 rests, which helps ensure a neat pack. If the packs contain an odd number of drumsticks, the raised inset of the next pack to be filled is on the opposite side of the pack (rhs); thus, for maximum flexibility each packline needs a magazine of both conformations of base component. Alternatively, the positioner will sort according to lhs or rhs packing. Product moves from position 810. When it reaches position 820, pushrod 830 moves product 821 in direction shown by arrow D from position 820 over pack wall 807 to position 840 (indicated by dotted lines) on guide chute or platform 845. Second pushrod 850 then moves product from position 840 forward and down guide shoot 845, which is slightly declined, to position 860, ensuring that the product is tightly packed. In order to prevent damage to pack 805 pushrod heads 835, 855 are provided with force transducers and/or limit switches which limit the forward movement of pushrods 830, 850 respectively.

Once the product is positioned on base component 800 conveyor 520 and pack 805 are indexed one position in the direction shown by arrow E, and the cycle repeats until pack 805 has been filled with product. The final package assembler folds edge 870 upwards along crease 875 and the product is sealed within package 805 in the desired overwrap.

This system is also suitable for packing sausages, usually with only minor modification.

EXAMPLE 2

The packaging line just described can be extended upstream to provide further automation to the system, incorporating an early alignment step, assessment of drumstick weight, and quality control steps.

Drumsticks are usually the last primals left on the gambrel in typical automated systems for poultry carcass breakdown. The fixed position of the gambrel in these systems makes it very practical as a reference point for image location by an IAS and for establishing inspection windows. Drumstick dimensions and quality attributes (including incomplete or inaccurate separation from the rest of the carcass) are obtainable before dismount. Since dismount from the gambrel is sequential, drumstick weights can be determined via an in-line weigh beam by difference.

Figure 12:
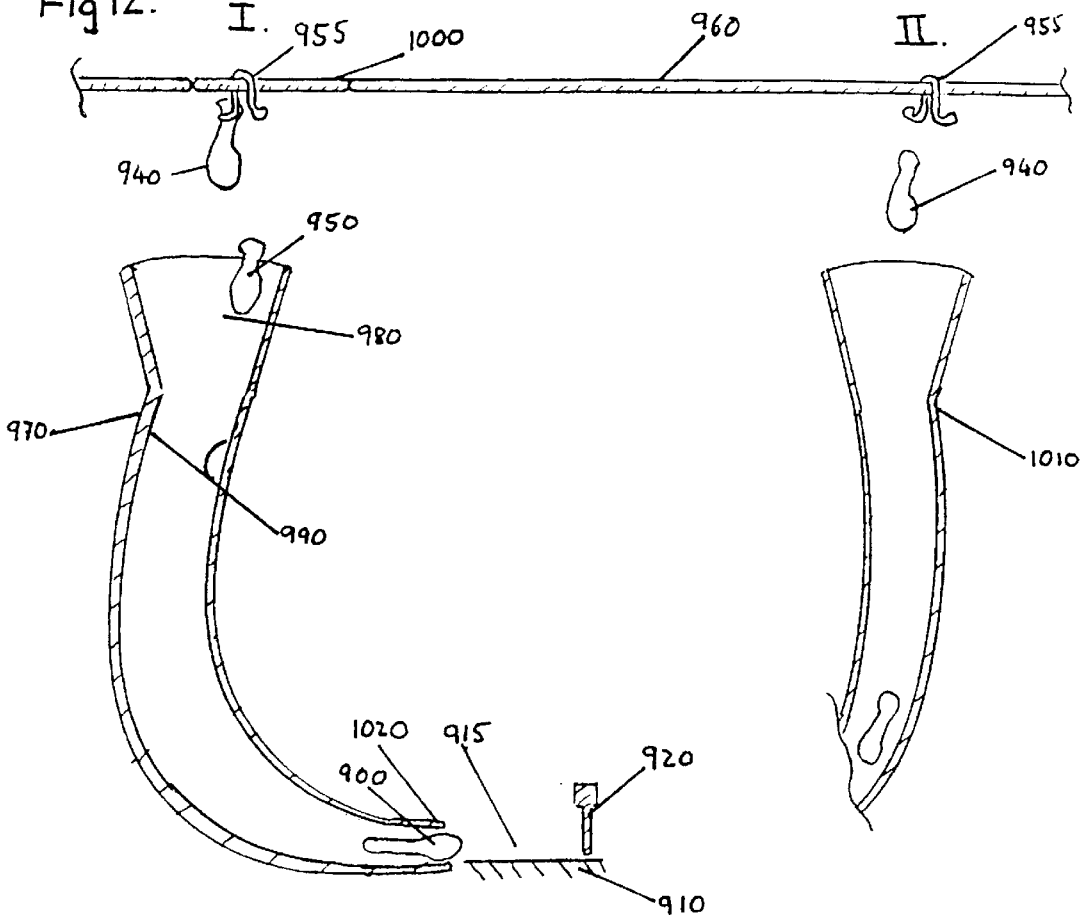
FIG. 12 is a side elevation of part of conveying means of a preferred line for packaging poultry drumsticks, showing transfer of drumsticks from processing line to chute, and from chute to primary conveyor.

FIG. 12 shows drumstick 940 attached to gambrel 955 at position I on processing line 960. The combined weight of tared gambrel 955 and drumsticks 950,940 is obtained before dismount via in-line weigh beam 1000. Drumstick 950 is then dismounted from gambrel 955 and falls into chute 970; the weight of gambrel 955 and remaining drumstick 940 is then obtained and the individual weights of drumsticks 950, 940 calculated. Chute 970 has a conically shaped entry head 980 followed by sides 990 which gently taper to the required diameter, both aspects of design helping to facilitate the product falling both along its major axis and head first, thereby achieving at least an increased incidence of correctly aligned product; typically, at least 80% of the drumsticks dismounted from the line are correctly aligned by the time they leave the chute. PTFE coating, polished stainless steel or a slightly moist surface to sides 990 ensure a smooth slide.

Gambrel 955 with drumstick 940 proceeds along processing line 960 to position II, where drumstick 940 dismounts from gambrel 955 and enters second chute 1010. Second chute 1010 is similar in design to chute 990 but aligns drumsticks predominantly in the opposite direction.

If used, a suitable location for an IAS to obtain an image of a gambrel with its associated drumsticks would be at position I, probably during the weighing procedure and before the first dismount signal is sent, although in some lines a position upstream of I may be more convenient. Drumsticks flagged as reject by the IAS will not be dismounted into chutes 970, 1010 but will continue on their gambrel along line 960 downstream of position II where eventually they will be dismounted into a reject stream and treated appropriately.

Figure 14:
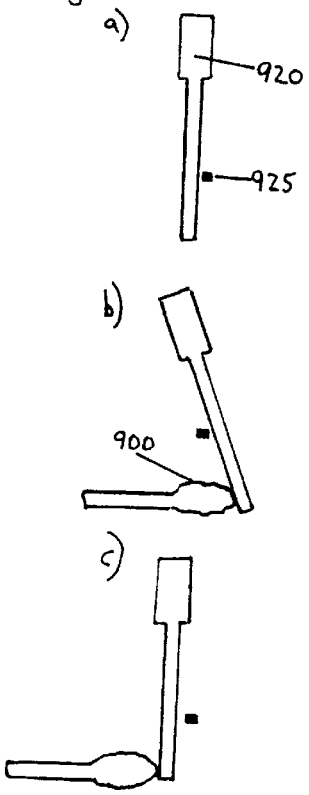
FIG. 14 is a side view of an arrester used to arrest the movement of a drumstick.
Figure 13:
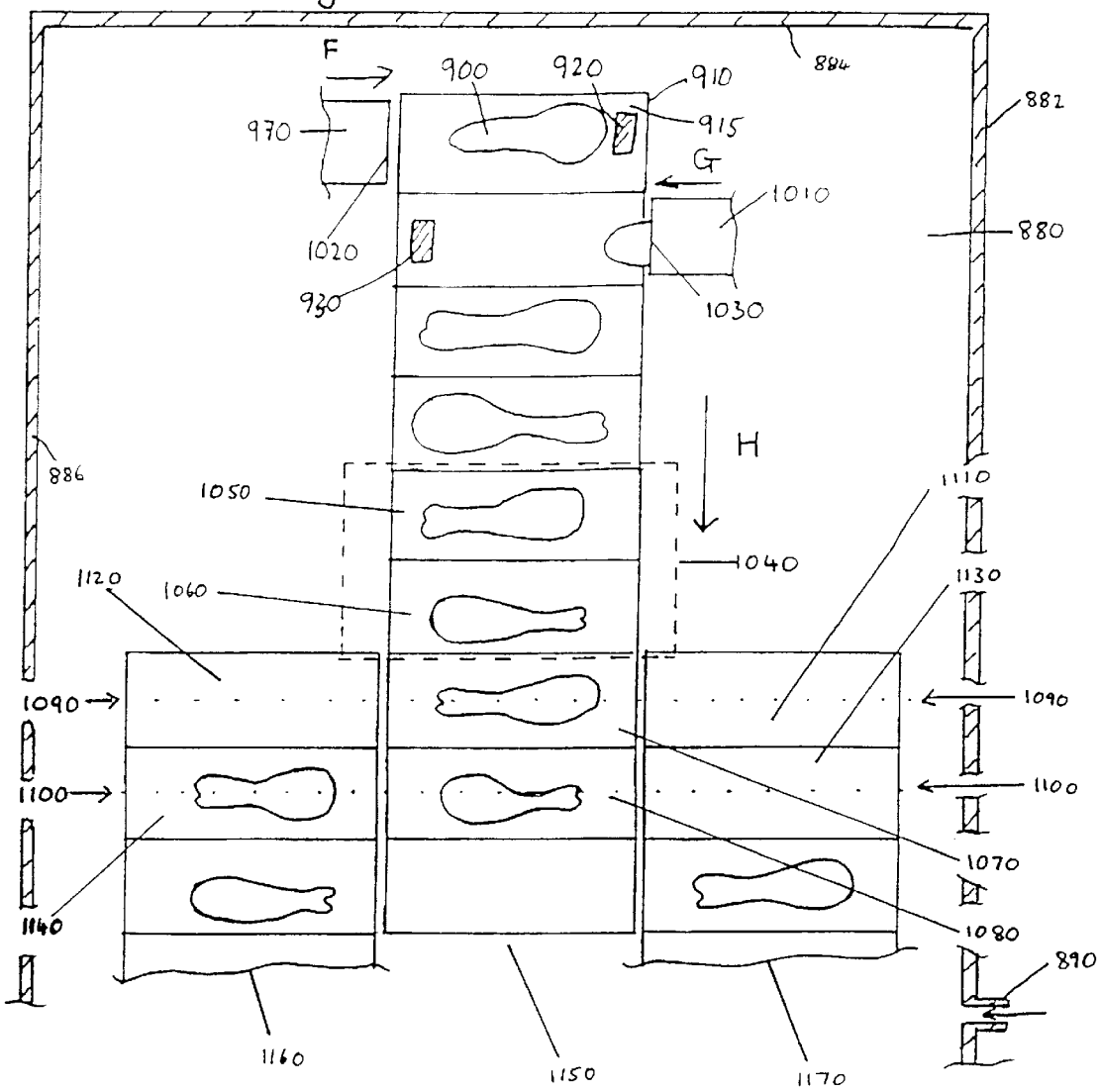
FIG. 13 is a plan view of the region immediately downstream of that shown in FIG. 12, showing a primary conveyor and the first part of two secondary conveyors.

As shown in FIG. 13, primary conveyor 910 accepts product from first chute 970 via chute exit 1020 and from second chute 1010 via chute exit 1030 in the directions shown by arrows F, G respectively. Drumstick 900 leaves chute 970 at 90° to the flow (shown by arrow H) of primary conveyor 910 into compartment 915. Arrester 920, a top-hinged resilient mechanical plate, (see also FIG. 14*a*) arrests the movement of drumstick 900 by absorbing the energy from product inertia (FIG. 14*b,c*). Movement of arrester 920 (detected by mechanical contact, or photoeye 925) and/or arrester 930 (the corresponding arrester serving product from chute 1010) instructs a programmable logic controller (PLC) to prepare to index conveyor 910 by two compartments in the direction of arrow H. Indexing can be initiated according to any of a variety of combinations of signals from arresters 920, 930, as preferred, but a simple approach is for indexing to be time limited, so that in the absence of a signal from one of the arresters within the prescribed time still causes indexing but a "missing product signal" is sent to the PLC. Two or more consecutive missing product signals from the same side could indicate problems such as a blocked chute or a stopped line.

Each drumstick is now aligned EW or WE and constrained within its compartment. Paired drumsticks, one from either chute, are indexed into the field of view 1040 (shown by hatched lines) of an IAS. Suitable software analyses the image obtained, firstly by providing suitable windows to separate out the image of each drumstick for separate analysis. Incidental background detail of conveyor 910 is dropped out from the image, and data as discussed in example 1 above are obtained for each drumstick. Weights are obtained via weighscales 1050, 1060. These data are passed to the PLC. Products for rejection will be identified at this stage.

Conveyor 910 indexes two compartments and drumsticks weighed and image analysed moved to positions 1070, 1080. Bidirectional positioners (eg as shown in FIG. 8), mounted on overhead rails indicated at 1090, 1100 and connecting dotted lines, move product alternately from 1070 and 1080 to 1110 and 1120 or 1130 and 1140, respectively. Limit stops constrain the movement of each positioner. If product in position 1070 and/or 1080 has been identified as reject the corresponding positioner is not activated and the product is indexed forward unselected. The rejected product subsequently drops from conveyor 910 to reject row 1150 to be reappraised elsewhere.

The direction of movement of positioners at 1090, 1100 initiates indexing of conveyor 1160 and/or 1170. This motion is normally synchronised with the indexing of conveyor 910. Conveyors 1160, 1170 only index one compartment at a time. Logic determines whether product is split 1 and 1 or 2 and 0, so as to ensure an even distribution of EW and WE aligned product. Incorrectly aligned product which cannot be otherwise corrected is treated as reject.

If quality assurance criteria have been applied by the IAS to the drumsticks i) on the gambrel and ii) on conveyor 910 there may be no further requirement for QA checking downstream. Secondary conveyors 1160, 1170 can now each serve as an infeed to three product line conveyors (as shown in FIG. 7 and discussed in Example 1; primary conveyor 500 is replaced by secondary conveyor 1160 or 1170, as appropriate).

In this example, the line space taken up by exit chutes 1020, 1030, primary conveyor 910, the field of view 1040 of the IAS, weighscales 1050, 1060, and the region of positional adjustment (the two conveyor rows served by the positioners at 1090, 1100) has been enclosed within chamber 880 which is defined by walls 882, 884, 886 (and an end wall located downstream of FIG. 13). Side wall 882 has an entry port 890 through which a modified gas mixture can be introduced. Alternatively or additionally, chamber 880 may also be provided with sources of UV-irradiation.

This example can easily be adapted for manual excision of drumsticks from the carcass, by the use of a weigh scale conveyor to convey the drumsticks from the cutting table and into the chute.

EXAMPLE 3

Figure 15:
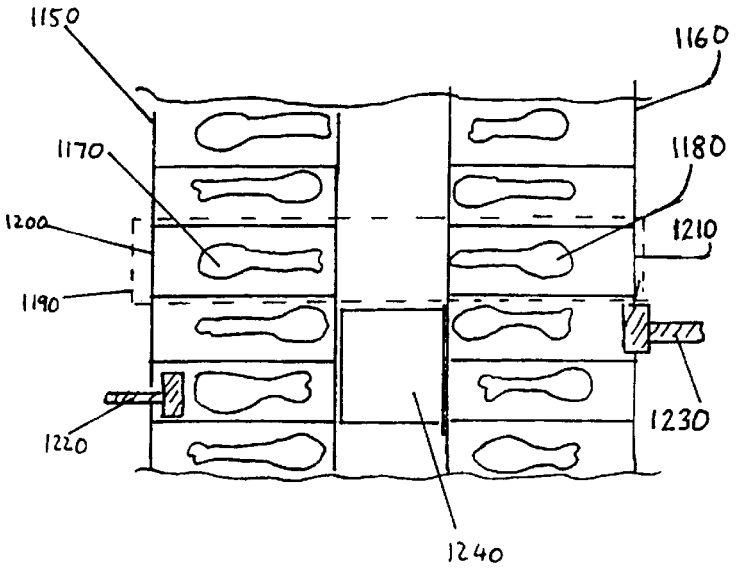
FIG. 15 is a plan view of a region of a packaging line, showing the location of reject mechanisms.

This example outlines an alternative reject strategy. FIG. 15 shows two primary conveyors 1150, 1160. Drumsticks 1170, 1180 have entered the field of view 1190 (shown by dashed lines) of an IAS. Suitable software analyses the image obtained, firstly by providing suitable windows to separate out the image of each drumstick for separate analysis. Incidental background detail of conveyors 1150, 1160 is dropped out from the image, and data as discussed in example 1 above are obtained for each drumstick. Weights are obtained via weighscales 1200, 1210. Drumsticks flagged for rejection at this stage will be rejected by pushrod 1220 (serving conveyor 1150) or pushrod 1230 (serving conveyor 1160) pushing the product into reject chute 1240. Rejection of product at this stage ensures that the subsequent linear motion of the product positioner is always limited to a single index, thus simplifying both movement and control.

EXAMPLE 4

The application of the invention to pork loins has already been touched upon. The embodiment discussed as Example 1 above is also suitable for use with "pulled" (ie boneless) pork loins and associated muscle cuts such as tenderloins, once any necessary and/or obvious change of scale is effected (see especially FIGS. 7 & 8). Product is manually located on the primary conveyor and is conveyed to within the field of view of an IAS, which includes a region of the conveyor incorporating a weighscale. In addition to data on dimensions and position, the IAS obtains information on the colour of the loin. Product flagged for rejection may be rejected by a pushrod system, as in Example 3, or may be effected by a double indexed move of the product positioner as explained in Example 1. The design of the product positioner may be easily determined by reference to FIG. 8.

Three product packing conveyors are used (corresponding to 510, 520, 530 in FIG. 7). Loins are assigned to particular packing conveyors on the basis of combinations of footprint, weight (especially to ensure minimum pack giveaway), and colour. The line is especially well suited to sorting according to product type: as a familiar example, according to the butchery method (eg centre, full cut, or butterfly).

Figure 16:
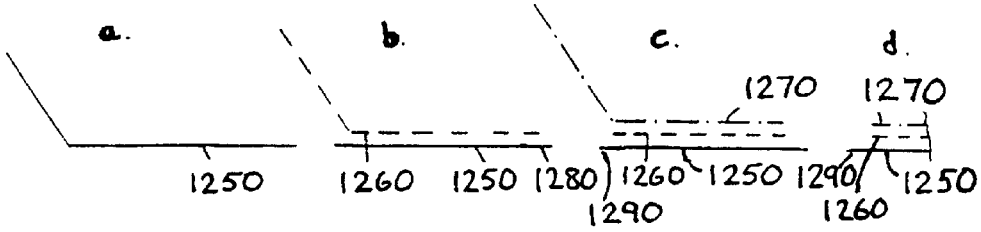
FIG. 16 shows schematically the sequential provision of layers in preparing a base component of a package as used in a preferred embodiment.
Figure 17:
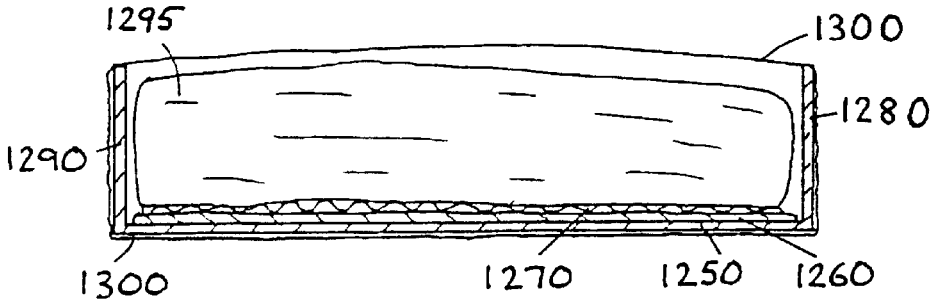
FIG. 17 is a section of a package produced using the sequence shown in FIG. 16.

The base component of the package comprises three layers which are sequentially assembled into trays prior to product arrival. As shown schematically in FIG. 16*a*, a length of supportive base material 1250 is pulled into the system and cut to the desired length (either a standard length, or according to footprint dimensions of the loin as determined by the IAS) prior to the arrival of the loin at the loading station. The length will include leading and trailing extensions 1280, 1290 respectively which are folded up to form the ends of the package (see FIG. 17) as the packing process reaches completion. Base material 1250, which may be sheet or on a reel feed, is typically stiff card coated with a moisture repellent. The cut length now passes forward and under a second feed station (FIG. 16*b*) which cuts a length of absorbent pad 1260 and drops or places it in place on top of base layer 1250. The pad 1260 may be loose laid; alternatively it may be fixed by adhesive or moisture, or by physical constraining such as by imparting risings to the back sides and front and back edges of the package during assembly. Absorbent material 1260 is used to absorb any moisture or product drip or purge that exudes from the loin during the packaging process or subsequent storage or transportation.

The final stage of base component assembly occurs when the bilayer moves forward and under a third station (FIG. 16*c*) which cuts and places a corrugated or raised dimple perforated length (or top piece) 1270 on top of the partially assembled pack. Top piece 1270 is used to support the meat cut in a manner which produces the minimum of surface area in contact with the meat, yet at the same time allows drip and purge from the meat to be collected and directed into absorbent layer 1260 but maintain a discrete separation between both so that the surface of the meat remains dry.

The assembled base component now moves forward to the product loading station where the loin 1295 drops into position. Leading and trailing extensions 1280, 1290 respectively are raised to form the ends of the package; the raised ends will keep the packaging wrapping material from making direct contact with the product, which has additional benefits in maintaining and extending product shelf life and reducing the advance of microbial contamination across the surface of the product. The package is then either placed in a preformed wrapper or bag 1300, or the bag or wrapper 1300 is formed around the package. The package is then gas-flushed or vacuum treated before sealing.

The process described in this example can be carried out in an aseptic environment provided by UV-irradiation as described previously. Alternatively or additionally, it may be carried out in a modified atmosphere with the same or similar composition to the gas mixture used in the final package, which assists in reducing the duration of the air/gas evacuation stage and thereby the whole sealing and packaging cycle time.

EXAMPLE 5

Poultry drumsticks are conveyed on a comparted conveyor into the field of view of an IAS and the IAS obtains images of each drumstick. The IAS compares each image obtained against standard images contained in its associated database. Information on any compartment containing incorrectly oriented product, or product identified as requiring rejection, is passed to the system controller which "flags" the compartment for treatment downstream.

Figure 18:
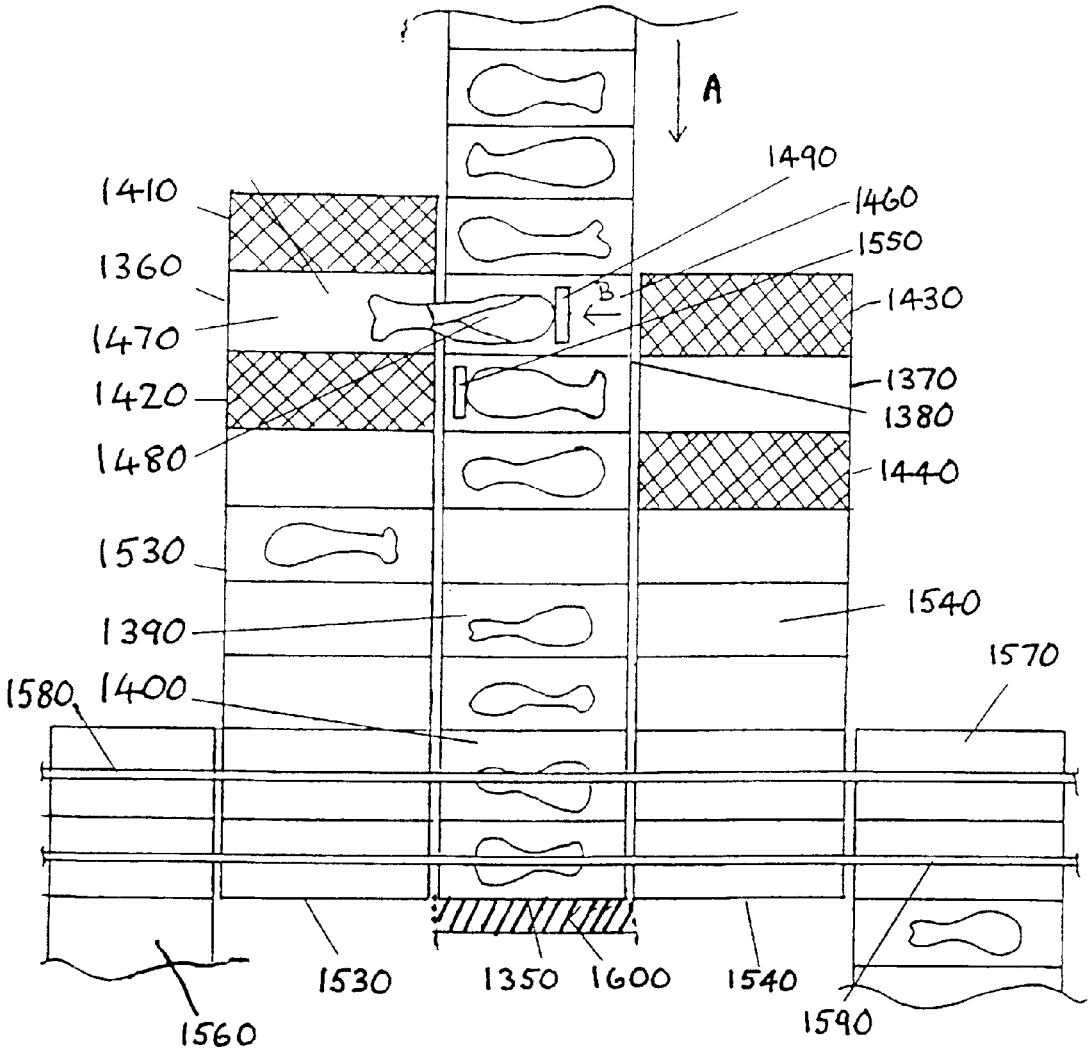
FIGS. 18 and 19 are respectively schematic plan and side views of a module for correcting substrate orientation.
Figure 19:
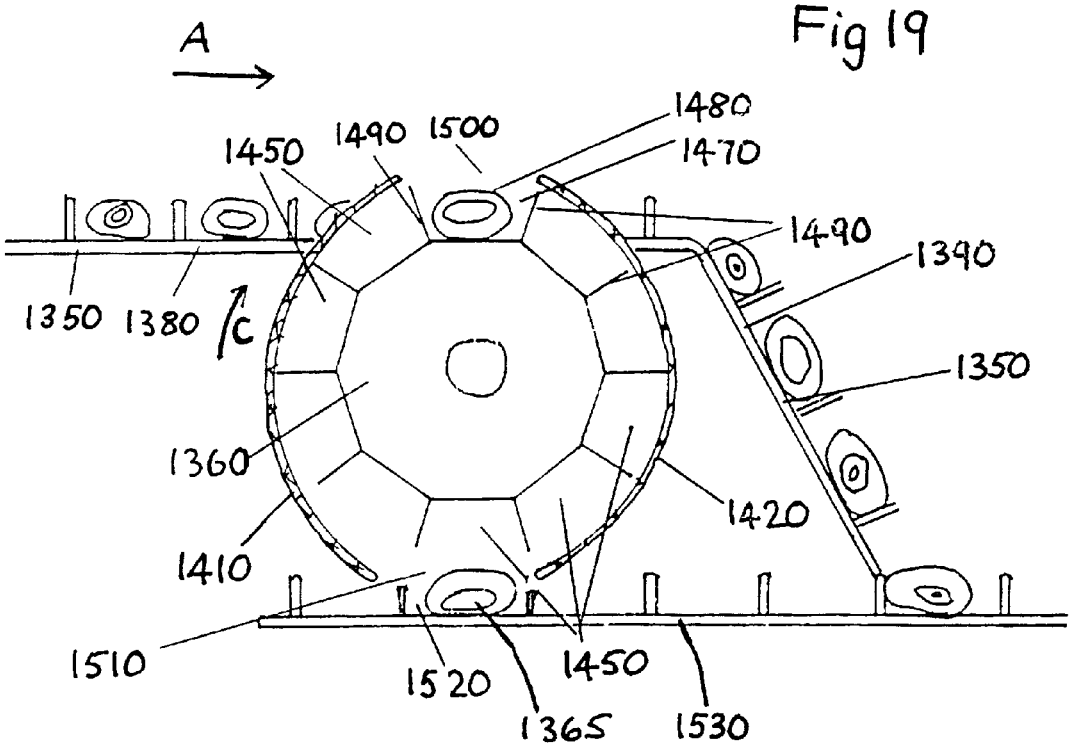

In FIGS. 18 and 19, stepped movement of primary conveyor 1350 in the direction shown by arrow A has brought conveyor compartment 1460, which has previously been identified by the IAS as containing an incorrectly oriented drumstick and "flagged" accordingly, into sideways alignment with compartment 1470 of inverting polygonal wheel 1360. Under the direction of the controller, paddle 1490 of an overhead driven pusher moves drumstick 1480 in the direction shown by arrow B, transverse to the conveying direction, off primary conveyor 1350 and into compartment 1470 of the inverting wheel 1360.

As shown in FIG. 19, the orientation of drumstick 1480 is corrected by the inverting action of polygonal wheel 1360. Wheel 1360 has projections 1490 that extend radially from the corners of the polygon and define compartments 1450, 1470. Retaining grid 1410, 1420, which has openings 1500, 1510 to allow entry and exit, respectively, prevents product from falling out of a compartment as it is stepped around wheel 1360 in the direction shown by arrow C. At the bottom of wheel 1360 the inverted product 1365 drops through opening 1510 into compartment 1520 of lower conveyor 1530.

Because in this example primary conveyor 1350 indexes two compartments at a time, a second wheel 1370 is provided on the opposite side of conveyor 1350 and offset relative to wheel 1360 by one compartment. Wheel 1370 is shown in FIG. 18 with its retaining grid 1430, 1440 and lower conveyor 1540. Paddle 1550 of the corresponding overhead pusher is also shown.

The inverting action of polygonal wheels 1360, 1370 requires the conveying line to operate at two levels, as shown in FIG. 19. Correctly oriented product passes between wheels 1360, 1370 on upper run 1380 of conveyor 1350 and is transported to lower run 1400 by a short inclined run 1390 which drops at an angle of 45°–65°.

Having passed through the product rotation module, product is moved to the appropriate secondary conveyor 1560, 1570 by positioner 1580 or 1590, as appropriate. Positioners 1580, 1590 are situated above the belt as previously described. Product flagged for rejection drops from the end of conveyor 1350 into reject channel 1600.

The rate of rotation of polygonal inverting wheels 1360, 1370 and the stepped advance of conveyors 1530, 1540 are chosen so that there is no loss of position of the inverted product relative to its original compartment.

Although this example has referred to poultry drumsticks, it will be appreciated that the basic design of the inverting wheel is applicable to other product such as pork loins, for example, with the necessary change of scale. For instance, in a drumstick packing line the difference in height between the upper 1380 and lower 1400 runs of the conveyor is typically about 25 cms, while for pork loins it is usually about 60 cms.

EXAMPLE 6

This example describes a complete line for the packing of poultry drumsticks, and brings together in one line a number of the features discussed previously.

Figure 20A:
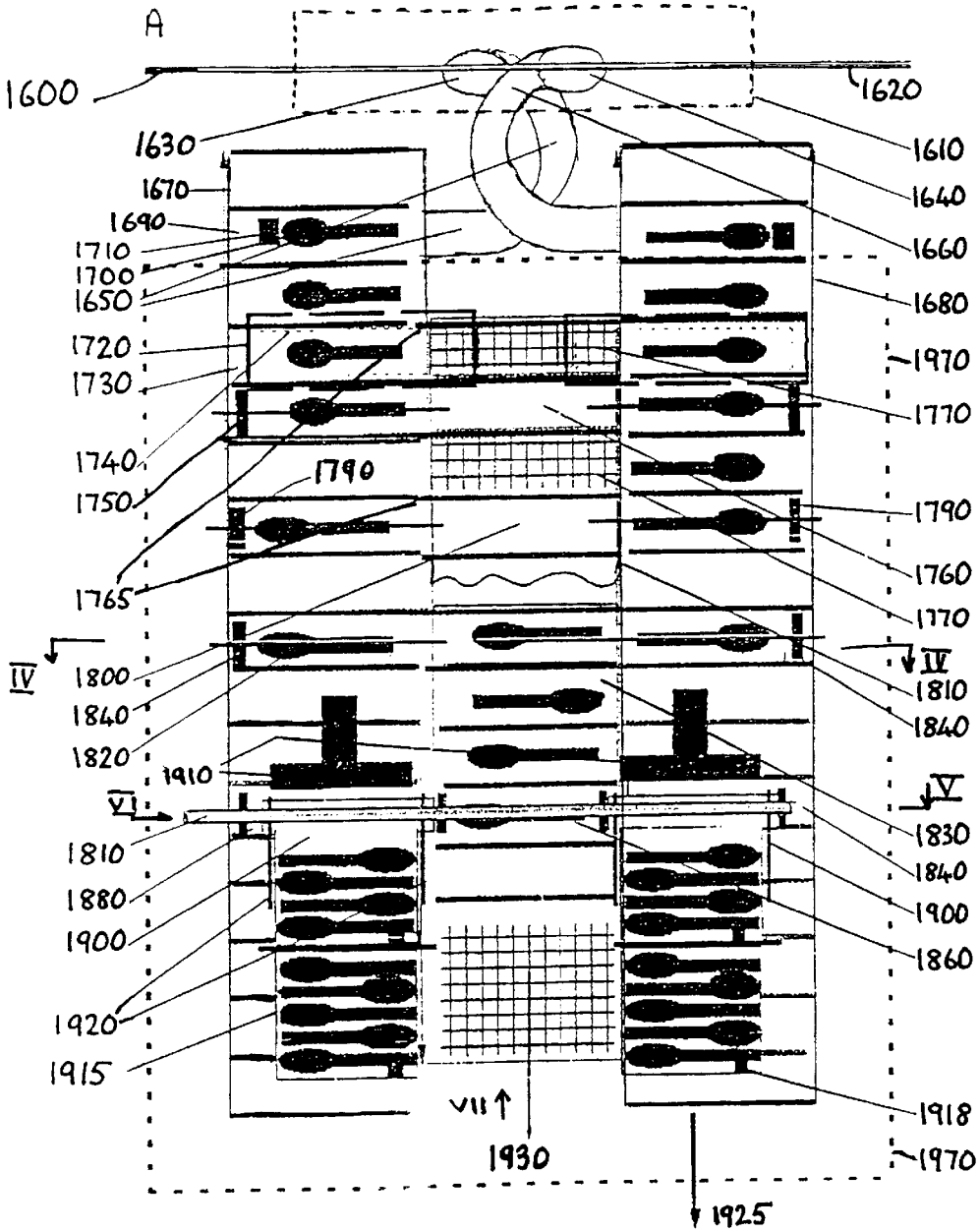
FIG. 20A is a schematic plan view of a packaging line embodying the invention.

Referring to FIG. 20A, the remaining elements of the chicken carcass are excised and the two drumsticks remain on the gambrel on input processing rail 1600. The drumsticks move into the field of view 1610 (shown by dotted lines) of an IAS. The IAS inspects and measures the drumsticks on the gambrel and only issues a dismount signal to drumsticks that satisfy the various criteria ("qualifying" drumsticks) at this stage. Drumsticks that fail on dimension, quality or other criteria continue along the reject output rail 1620. Dismounted qualifying drumsticks fall into conical entry heads 1630, 1640 of chutes 1650, 1660.

The line is usually arranged such that all the qualifying left drumsticks fall into one chute and all the right drumsticks fall into the other chute, and as a consequence there are separate first conveyors 1670, 1680 for left/right drumsticks. (For ease of reference, only one conveyor will be considered here at any one time, as the description is equally applicable to the other conveyor. The lines can operate independently, however). Conveyor 1670 is indexed so that an empty compartment 1690 is ready to receive drumstick 1700 as it leaves chute 1650. The forward movement (ie transverse to the conveying direction) of drumstick 1700 is arrested by the pressure-sensitive head 1710 (which may be hydraulic, pneumatic or electric, or electronic/mechanical as shown in and described for FIG. 14). This sends a signal to the master controller which initiates a forward index of conveyor 1670.

The drumstick moves into the field of view 1720 (shown by heavily dashed line) of an IAS, which assesses alignment (EW, WE, or straddling a flange) and orientation (skin-side uppermost, or meat-side uppermost) and passes the information to the controller. The drumstick is also weighed (by in-line weighscale 1740 (or load cell or similar) indicated by faintly dashed line). All information is placed in stack by the controller.

Drumsticks "flagged" for correction of orientation by inversion are pushed laterally by paddle 1750 of an overhead piston into open compartment 1760 of product rotation module 1765 (see previous example, and FIG. 19). (Product rotation module 1765 is shown with retaining grids 1770 which prevent product falling from the conveyor or moving sidewise). At this point, the line becomes split into two levels (see FIG. 20C) with the inverted product exiting through bottom gap 1775 of module 1765 onto lower level conveyor 1780.

Product identified as correctly oriented continues to be indexed forward. The line again splits (see FIG. 20C) with product being pushed alternately from conveyors 1680, 1670 by paddles 1790 of overhead pistons 1795 into compartment 1800 of inclined conveyor 1810. Selection at this stage for either middle or upper level of the line may depend on product type, grade, weight ranges and/or production speed requirements. Product 1820 that remains on conveyors 1670, 1680 (which now form the middle level of the three-level packing line) is moved to middle level primary placement conveyor 1830 by paddles 1840 of overhead pistons 1850. In this way, the desired orientation sequence on the single comparted conveyor 1830 has been achieved.

Product is indexed forward to the product positioning station 1860 provided with a bidirectional continuous positioner 1870, as shown in FIG. 23. Positioner 1870 has continuous twin chains 2050, each comprising a lower, inner, or main drive chain 2052 and an upper (or outer) chain 2055 provided with deflector lugs 2060. At least some deflector lugs 2060 will have deflectors 2070 attached to them via respective deflector shafts 2075; the actual number of lugs 2060 provided with deflectors 2070 will depend upon a variety of factors such as line speed, product characteristics, number of recipient/donor conveyors served, etc. Each twin chain 2050 is mounted at one end of its run on drive sprocket 2080 and at the other end by free sprocket 2090. Drive sprockets 2080 are connected to, and driven by, stepper drive motors 3000, 3010.

The two drive motors 3000, 3010 are positioned at opposite corners of positioner 1870 (see FIG. 23D). Each motor drives in one direction only, the bidirectional nature of positioner 1870 arising from interaction between motors 3000, 3010. When the controller initiates any movement of the positioner it instructs one motor 3000 (for example) to drive and motor 3010 to "free-wheel", which co-operative action drives chain 2050 in one direction eg that shown by arrow X in FIG. 23B. Chain movement in the direction shown by arrow Y in FIG. 23B is effected by the opposite combination, ie motor 3010 drives while motor 3000 "free-wheels".

Deflector lugs 2060 are supported between sprockets 2080, 2090 by deflector guides 3020 mounted on guide support 3030.

In product positioning station 1860, on instruction from the controller, product moves one position offset left or right to secondary placement conveyors 1886, 1890 where it is pushed down loading ramp 1900 by placement piston 1910 into tray 1915. Tray 1915, which is provided with a small raised section 1918 at its front to control the position of the first drumstick, is positioned underneath and slightly forward of ramp 1900 to minimise travel distance. Product guides 1920 restrict sideways movement of product during filling of tray 1915. The operation continues until tray 1915 receives the requisite number of portions (all now in desired orientation and alignment sequence), when the finished tray moves forward to final wrap/stack 1925.

Upper level conveyor 1940 and lower level conveyor 1780 are similarly provided with product positioning stations 1950, 1960. Handling and packing at these stations is broadly as just described for station 1860. Any (or all) of the positioning stations can be arranged to feed a greater number loading ramps; and similarly, where additional sort stations are needed, an additional secondary positioning module can be used to move product to additional assembly stations.

Unallocated product, and product flagged for rejection, drop into end chute 1930, wherein the two types of product are separated by a diverter flap, for example, under the direction of the controller.

Transfer of product between conveyors transverse to the conveying direction can be facilitated by minor changes to the relative positioning of the conveyors, as illustrated in FIG. 21. The conveyor receiving the product is positioned slightly beneath the "donor" conveyor. Transfer is further facilitated by providing inclined regions 2040 at the edges of the conveyor slats 2050 (see also FIG. 22).

In FIG. 21A, which shows a schematic cross section of the middle level of the line on IV—IV in FIG. 20A, product is moved from first conveyors 1670, 1680 transversely centrally and inwardly to middle level primary placement conveyor 1830 which runs at a slightly lower level. In FIG. 21B, a similar cross section on V—V in FIG. 20A, transfer is from primary placement conveyor 1830 transversely outwardly to secondary placement conveyors 1880, 1890. Also shown in FIG. 21: first conveyor non-conveying runs 2020, 2030; primary placement conveyor return run 2010; drive sprockets 2000; overhead piston rod 1798; and piston/paddle support track 1792.

FIG. 22 illustrates detail of two slats 2055, 2065 as they would be configured in a conveyor, with interlock 2070. Each slat 2055, 2065 comprises slat bed 2050, inclined regions 2040, and a partition wall 2060. Partition walls 2060 define product compartments in a conveyor.

Product need never be touched by a non-sterile surface once it has entered the line. Conveyors 1670, 1680, 1780, 1830 can be automatically cleaned and sterilised on their return (non-conveying) run. The entire line can be located within an aseptic environment (eg under UV irradiation, with filtered sterile air, etc) and/or within a controlled atmosphere, as indicated by containment box 1970.

As with previous examples, although this example has been discussed with reference to poultry legs, the same basic approach is applicable to other product, eg pork loins, with suitable changes of conveyor dimensions and spacings, etc. Product that does not slide easily, for example tenderloins, may require loading on to a suitable carrier base at an early stage of conveying.

Figure 20B:
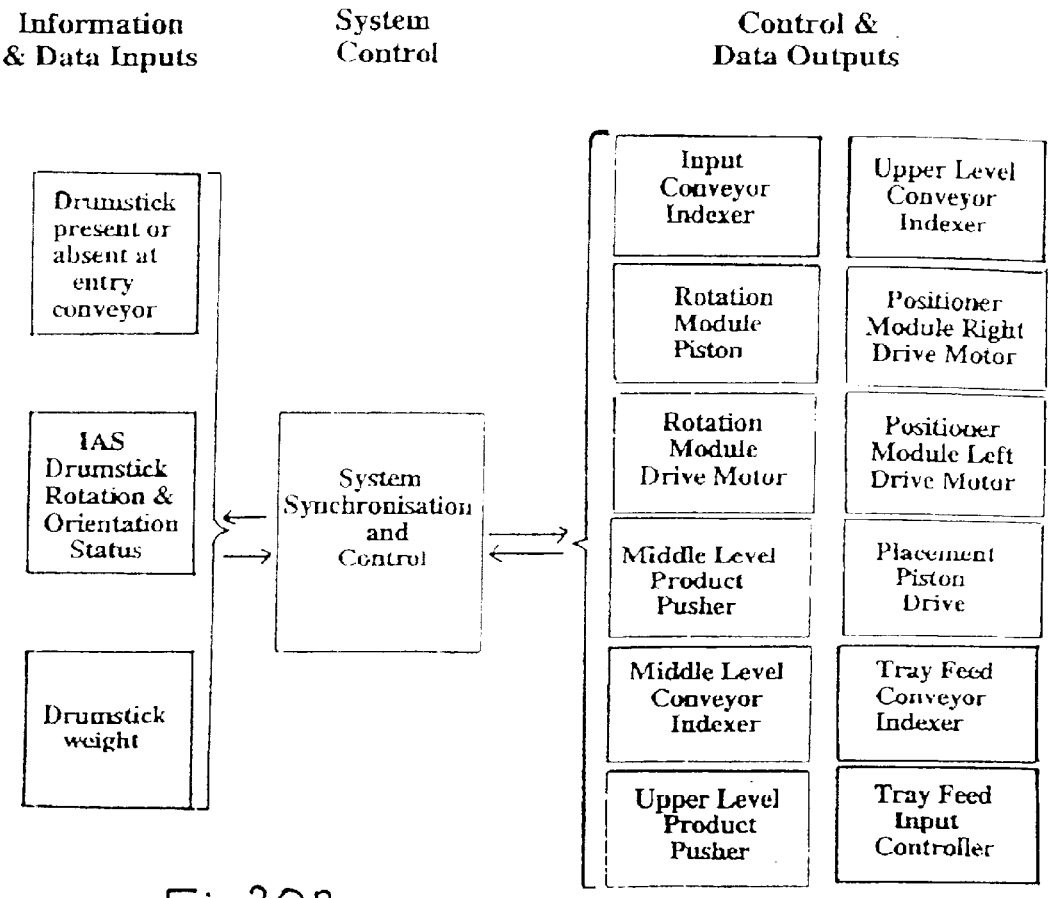
FIG. 20B is a block diagram for explaining the operation of the line of FIG. 20A.
Figure 20C:
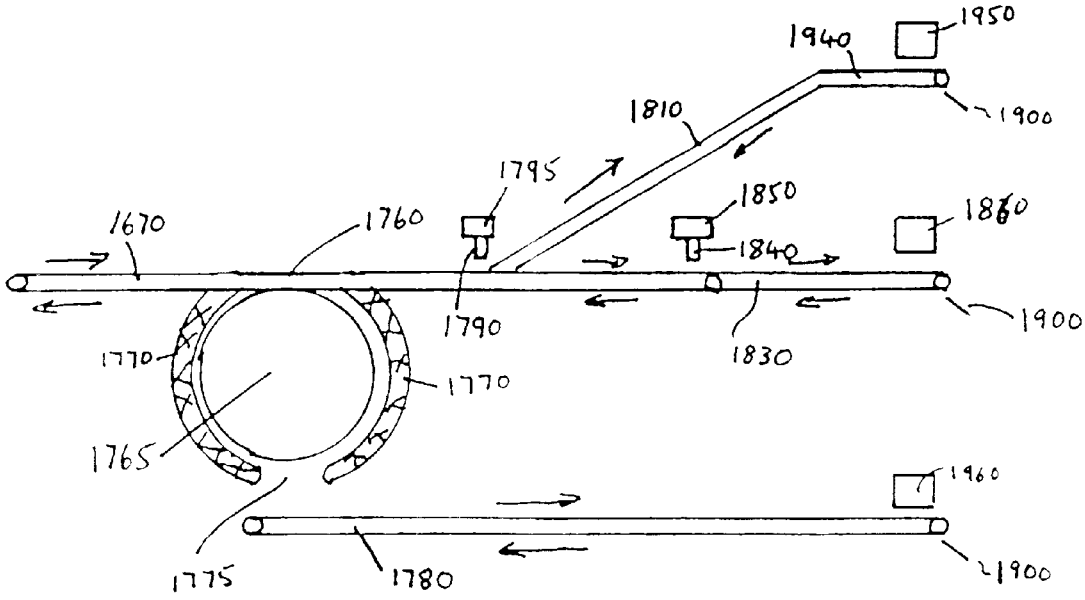
FIG. 20C is a schematic side view of the line of FIG. 20A.

FIG. 20B illustrates the interrelationship between the various controllers, data collectors and handlers, and effectors. The Information and Data Input units pass derived data and information (including error messages) to the System Control, and receive instructions (including overrides, correct/reset, etc) from System Control. The System Control instructs the Control and Data Output units to commence sequence (or override, correct/reset, etc) and receives from these various units information on completion of sequence, and/or error warnings.

The IAS is programmed before a packing run with the desired attribute parameters, but these can be updated as and when requirements change during the run. The IAS can also be reprogrammed between runs with a different set of criteria.

What is claimed is:

1. A method of packaging a substrate comprising (i) conveying the substrate on a conveyor into the field of view of an image analysis system and obtaining an image of the substrate on the conveyor from said system, (ii) comparing the image of the substrate against standard images held in a database, and thereby identifying the substrate and optionally its orientation, (iii) analysing the substrate image and, with reference to the database if necessary, determining the footprint dimensions of the substrate, (iv) selecting a package or a first package component of dimensions based on the footprint dimensions of the substrate, (v) transferring the substrate to the package or component, (vi) providing further components of the package if necessary, and integrating said further components with the package or the first component, and (vii) sealing the package or the first component.

2. A method according to claim 1 including the step of analysing the image of the identified substrate on the conveyor to determine the location of the substrate transverse to the conveying direction.

3. A method according to claim 1 including a step of analysing the substrate image to determine the alignment of the substrate relative to the conveying direction.

4. A method according to claim 1 including a step of analysing the substrate image to obtain information about the position and/or conformation of the substrate on the conveyor, and a step of altering the position and/or conformation dependent on said information.

5. A method according to claim 1 which is conducted substantially within a cavity delimited by walls and provided with a plurality of UV sources distributed around the walls and directed radially, inwardly such that UV radiation from the UV sources maintains substantially aseptic conditions within the cavity throughout the process.

6. A method according to claim 1 which further comprises obtaining the weight of the substrate, and wherein said selecting step (iv) is also carried out dependent on said weight.

7. A method according to claim 1 wherein said database also contains details of customer specifications and said selecting step (iv) is also carried out dependent on a comparison of said specifications with data determined for the substrate.

8. A method according to claim 1 including a step of analysing the substrate image to obtain data relating to substrate colour.

9. A packaging line which comprises: conveying means; an image analysis system suitable for obtaining images of substrates while they are being conveyed on the conveying means; means for comparing said images against standard images held in a database and on the basis of this comparison (i) recognizing each substrate, (ii) estimating the footprint of each substrate, and optionally (iii) determining the orientation of said substrate; a placement module; a controller or coordinator, able to direct the action of a placement module to select a first package component or a package of dimensions based on said footprint and arrange for the selected component or package to receive the substrate on transfer to the placement module and a final package assembler.

10. A packaging line according to claim 9 which is contained substantially within a cavity delimited by walls, said cavity being provided with a plurality of UV sources distributed around the walls and directed radially inwardly.

11. A packaging line according to claim 9 wherein the image analysis system is arranged to determine the location of a substrate transverse to the conveying direction.

12. A packaging line according to claim 9 wherein the image analysis system is arranged to determine the alignment of the substrate relative to the conveying direction.

13. A packaging line according to claim 9 wherein the final package assembler is provided with means for dispensing a modified atmosphere during at least part of the assembly of the final package before sealing the final package.

14. A packaging line according to claim 9 which is equipped with reject mechanisms which are arranged to be triggered by the image analysis system if it does not recognise the object or recognises the object but it is outside a pre-set quality or dimensional criterion.

15. A packaging line according to claim 9 further provided with means for positional adjustment of a recognized substrate.

16. A packaging line according to claim 15 wherein said means for positional adjustment is under the control of the image analysis system, either directly or indirectly via a separate microprocessor controller or programmable logic controller.

17. A packaging line according to claim 15 wherein the conveying means has a conveying surface and said means for positional adjustment comprise a plurality of retractable arms provided with blades, said blades being arranged such that the lowermost surface of each blade is close to, but does not touch, the conveying surface.

18. A packaging line according to claim 15 having positional adjusters sited on either side of the conveying means so as to be able to act cooperatively in effecting positional adjustment.

19. A packaging line according to claim 9 wherein said conveying means comprises variable speed multi-section conveyors operable to effect alignment of the substrates.

20. A packaging line according to claim 9 for packaging poultry drumsticks, wherein the conveying means, comprises a chute and a primary conveyor, said chute comprising a conically shaped entry head leading to a tubular section with walls which gradually taper to a chute exit; and wherein said image analysis system is positioned so as to obtain an image of a poultry drumstick while the drumstick is on the primary conveyor.

21. A packaging line according to any of claims 9 to 20 including means for weighing substrates.

22. A method of packaging a substrate, said method comprising:

conveying the substrate to be packaged on a conveyor into a field of view of an image analysis system;

using the image analysis system to obtain an image of the substrate on the conveyor;

comparing the image of the substrate so obtained with standard images maintained in a database so as to identify the substrate;

analyzing the substrate image to determine footprint dimensions of the substrate;

selecting a package of dimensions based on the footprint dimensions so determined;

transferring the substrate to the package so selected for packaging therein; and sealing the package with the substrate packaged therein.

23. A method according to claim 22 wherein the package comprises package components, wherein the substrate is transferred to a first package component and wherein at least one further package component is integrated with the first package prior to sealing the package.

* * * * *